US006209374B1

(12) United States Patent
Bradbury et al.

(10) Patent No.: US 6,209,374 B1
(45) Date of Patent: Apr. 3, 2001

(54) ROLL-FORMING MACHINE WITH ADJUSTABLE COMPRESSION

(75) Inventors: Philip E. Bradbury, McPherson; Karl E. Voth, Newton; Gregory S. Smith, McPherson, all of KS (US)

(73) Assignee: The Bradbury Company, Inc., Moundridge, KS (US)

( * ) Notice: Subject to any disclaimer, the term of this patent is extended or adjusted under 35 U.S.C. 154(b) by 0 days.

(21) Appl. No.: 09/415,865

(22) Filed: Oct. 8, 1999

(51) Int. Cl.[7] ..... B21D 5/08; B21B 31/22
(52) U.S. Cl. ..... 72/181; 72/246
(58) Field of Search ..... 72/181, 180, 182, 72/176, 246

(56) References Cited

U.S. PATENT DOCUMENTS

| | | | | |
|---|---|---|---|---|
| 1,125,984 | | 1/1915 | Dumas . | |
| 1,352,813 | * | 9/1920 | Kennicott | 72/180 |
| 1,366,331 | | 1/1921 | Palmer et al. . | |
| 1,669,411 | | 5/1928 | Clark . | |
| 1,673,787 | | 6/1928 | Frahm et al. . | |
| 2,102,355 | | 12/1937 | Cummins | 80/54 |
| 2,195,398 | | 4/1940 | Duda | 64/30 |
| 2,294,324 | | 8/1942 | Wilkens et al. | 153/28 |
| 2,343,680 | | 3/1944 | Linderme, Sr. | 205/7 |
| 2,561,634 | | 7/1951 | Picton | 153/54 |
| 2,601,794 | | 7/1952 | Wood | 80/55 |
| 2,664,019 | | 12/1953 | Henderson | 80/35 |
| 2,774,263 | | 12/1956 | Leufven | 80/56 |
| 3,006,225 | | 10/1961 | Mamas | 80/56 |
| 3,345,848 | * | 10/1967 | Henschker | 72/246 |
| 3,345,849 | | 10/1967 | Lowy | 72/249 |
| 3,348,403 | | 10/1967 | Bartley | 72/237 |
| 3,355,922 | | 12/1967 | Utashiro et al. | 72/178 |
| 3,435,649 | * | 4/1969 | O'Brien | 72/246 |
| 3,452,568 | | 7/1969 | Vihl | 72/137 |
| 3,724,251 | | 4/1973 | Wegner | 72/203 |
| 3,785,191 | * | 1/1974 | Dewey | 72/181 |
| 3,823,592 | | 7/1974 | Colbath | 72/181 |
| 3,914,971 | | 10/1975 | Colbath | 72/178 |
| 4,033,165 | | 7/1977 | Arimura et al. | 72/205 |

(List continued on next page.)

FOREIGN PATENT DOCUMENTS

| | | | | |
|---|---|---|---|---|
| 1 777 039 | | 10/1971 | (DE) . | |
| 0841998 B1 | | 6/1999 | (EP) . | |
| 25770 | | 11/1897 | (GB) . | |
| 42-4763 | | 2/1967 | (JP) . | |
| 47-37833 | | 9/1972 | (JP) . | |
| 415060 | * | 2/1974 | (RU) | 72/246 |
| 1085708 | | 4/1984 | (SU) . | |
| WO 97/04892 | | 2/1997 | (WO) . | |

OTHER PUBLICATIONS

Pinch Roll Drawing—The Bradbury Company Inc.—prior art.

Lockformer Pillow Block Drawing—prior art.

* cited by examiner

*Primary Examiner*—Daniel C. Crane
(74) *Attorney, Agent, or Firm*—Marshall, O'Toole, Gerstein, Murray & Borun

(57) ABSTRACT

A roll-forming machine is provided with a base structure, a plurality of first roll-forming stations that form a first component having a Z-shaped cross section, and a plurality of second roll-forming stations that form a second component having a C-shaped cross section. At least one of the roll-forming stations has a pair of rotatable arbors adapted to support a plurality of forming rolls and a pair of support structures adapted to support a plurality of bearing assemblies. The roll-forming station also includes a pair of adjustment mechanisms that allow the position of some of the bearing assemblies to be adjusted and a pair of compression assemblies that exert a force upon some of the bearing assemblies when the bearing assemblies are moved away from an initial position.

21 Claims, 13 Drawing Sheets

U.S. PATENT DOCUMENTS

| | | | |
|---|---|---|---|
| 4,064,727 | 12/1977 | Amano et al. | 72/179 |
| 4,145,905 | 3/1979 | Mattie | 72/177 |
| 4,187,710 | 2/1980 | Stikeleather | 72/204 |
| 4,237,714 | 12/1980 | Polukhin et al. | 72/242 |
| 4,368,633 | 1/1983 | Nogota | 72/239 |
| 4,557,129 | 12/1985 | Lash et al. | 72/176 |
| 4,716,754 | 1/1988 | Youngs | 72/178 |
| 4,724,695 | 2/1988 | Stoehr | 72/181 |
| 4,787,232 | 11/1988 | Hayes | 72/176 |
| 4,831,857 | 5/1989 | Levy et al. | 72/181 |
| 4,912,956 | 4/1990 | Matricon et al. | 72/243 |
| 4,959,986 | 10/1990 | Kranis, Sr. | 72/129 |
| 4,969,347 | 11/1990 | Matsuo et al. | 72/247 |
| 4,974,435 | 12/1990 | Vandenbroucke | 72/176 |
| 5,158,002 | 10/1992 | Matsunaga et al. | 83/479 |
| 5,163,311 | 11/1992 | McClain et al. | 72/181 |
| 5,187,964 | 2/1993 | Levy | 72/181 |
| 5,199,291 | 4/1993 | Bahl, Jr. et al. | 72/181 |
| 5,644,942 | 7/1997 | Bradbury | 72/237 |
| 5,829,295 | 11/1998 | Voth et al. | 72/181 |
| 5,855,133 | 1/1999 | Hayes | 72/176 |
| 5,983,691 | 11/1999 | Voth et al. | 72/178 |
| 6,000,266 | 12/1999 | Strecker et al. | 72/181 |

FIG. 4A
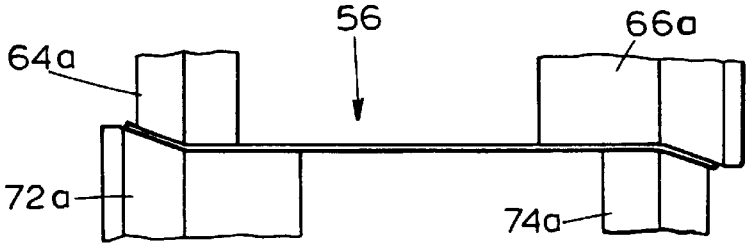
FIG. 4B
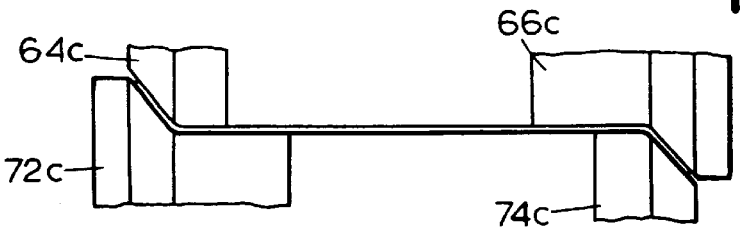
FIG. 4C
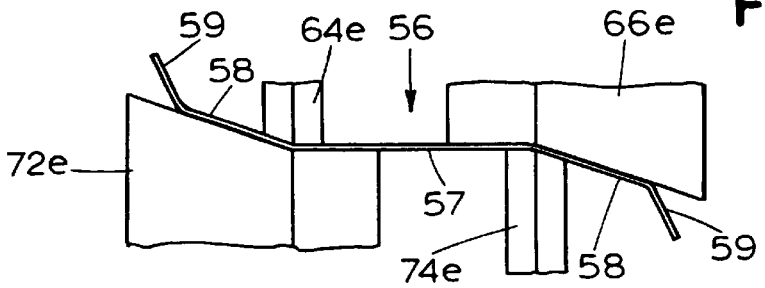
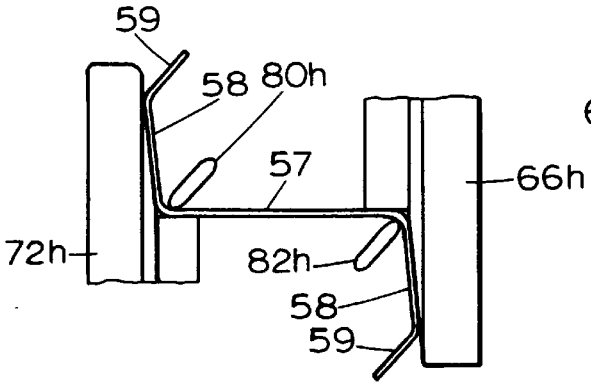
FIG. 4D
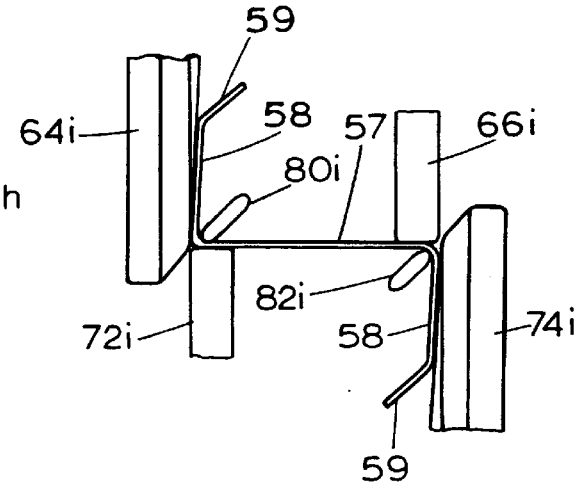
FIG. 4E FIG. 5
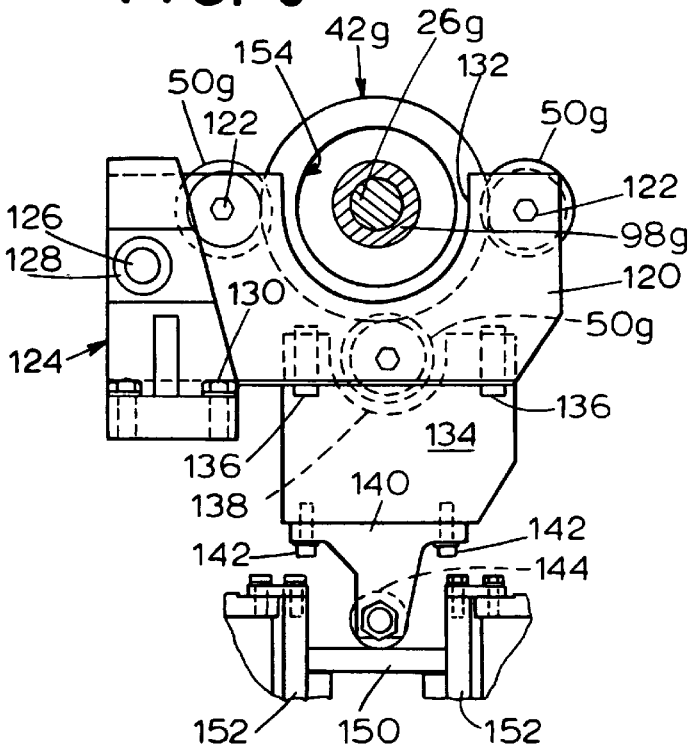
FIG. 6
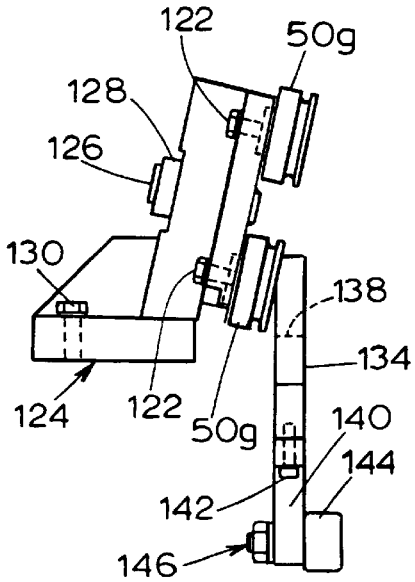
FIG. 7
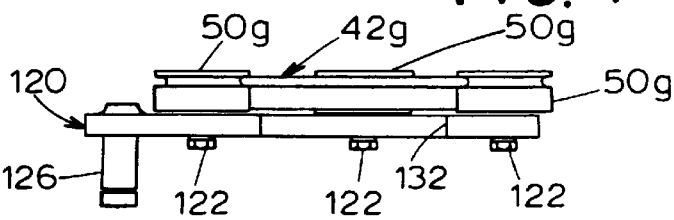
FIG. 8
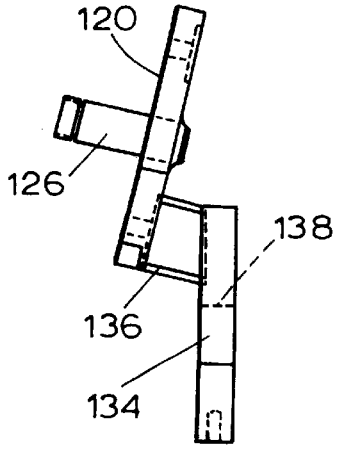
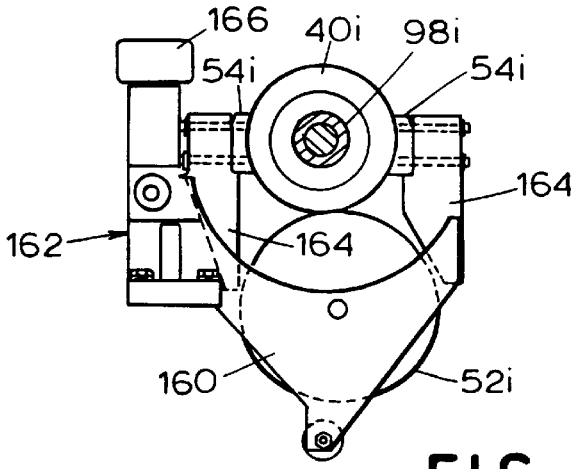
FIG. 9

ROLL-FORMING MACHINE WITH ADJUSTABLE COMPRESSION

BACKGROUND OF THE INVENTION

The present invention relates to a roll-forming machine having adjustable compression between forming rolls of the forming roll stations.

Roll-forming machines typically include a plurality of roll-forming stations that are used to transform a planar sheet of metal into a component having either a C-shaped or Z-shaped cross-sectional area, for example. The component, such as a C-purlin or Z-purlin, typically has a center portion, a pair of leg portions joined to the center portion by a substantially right angle bend formed by the roll-forming machine, and a flange joined to each leg portion by a respective bend formed by the machine.

Typically, the flanges of a C- or Z-shaped component are made first by a plurality, such as three, roll-forming stations. The first of these stations makes an initial pair of bends at the desired transverse locations on the sheet, and then the successive stations for forming the flanges increase the previously made bends until the flanges are at the proper angle relative to the center portion of the sheet. The legs of the component are then formed by a plurality of roll-forming stations in a similar manner.

Each of the roll-forming stations typically includes a pair of frame members in which a pair of rotatable arbors are journalled, one arbor disposed directly above the other, and a pair of sleeves which cover a portion of the arbors, the sleeves being slidable over the arbors. Each roll-forming station includes at least two pairs forming rolls, two of the forming rolls being fixed to the arbors and the other two forming rolls being fixed to the sleeves. The circumferential ends of the upper and lower forming rolls are vertically spaced apart by a distance corresponding to the thickness of the sheet of material being bent, and the shape or contour of the forming rolls controls the degree to which the sheet is bent. The use of sleeves which are slidable on the arbors and which rotate with the arbors allows the horizontal spacing of the forming rolls on each arbor and sleeve to be varied so that the transverse widths of the center portion and the leg portions of the components being formed can be adjusted.

The sheet of material is forced through the roll-forming machine by friction between the sheet and the rotating forming rolls. The forming rolls of a plurality of the roll-forming stations, e.g. the forming rolls of every other station, are rotatably driven to ensure that there is enough driving power to force the sheet through the machine.

In the case of a C-shaped component, the flanges are made by bending the transverse ends of the sheet in the same direction, for example, downwards, whereas for a Z-shaped component the flanges are made by bending the transverse sheet ends in opposite directions. After the flanges are formed on the transverse ends of the sheet, the legs are formed by a plurality of roll-forming stations by a similar process. To form a component in the above manner, up to ten or more roll-forming stations may be incorporated in the roll-forming machine.

SUMMARY OF THE INVENTION

In one aspect, the invention is directed to a roll-forming machine having a base structure, a plurality of first roll-forming stations associated with the base structure that form a first component having a Z-shaped cross section and a plurality of second roll-forming stations associated with the base structure that form a second component having a C-shaped cross section.

At least one of the roll-forming stations is provided with a first rotatable arbor adapted to support a first pair of forming rolls, a second rotatable arbor adapted to support a second pair of forming rolls, a first support structure, a first bearing assembly associated with the first support structure that rotatably supports a first portion of the first arbor, a second bearing assembly associated with the first support structure that rotatably supports a first portion of the second arbor, a second support structure, a third bearing assembly associated with the second support structure that rotatably supports a second portion of the first arbor, and a fourth bearing assembly associated with the second support structure that rotatably supports a second portion of the second arbor.

The roll-forming station also includes a first adjustment mechanism that allows the position of the first bearing assembly to be adjusted relative to the position of the second bearing assembly, a second adjustment mechanism that allows the position of the third bearing assembly to be adjusted relative to the position of the fourth bearing assembly, a first compression assembly that exerts a force upon the first bearing assembly when the first bearing assembly is moved away from the second bearing assembly, and a second compression assembly that exerts a force upon the third bearing assembly when the third bearing assembly is moved away from the fourth bearing assembly.

Each of the support structures may comprise a vertically disposed support plate and a slot formed in the support plate, and at least one of the bearing assemblies supported by each support plate may be movable along a vertical direction within the slot. The adjustment mechanisms may be provided in the form of adjustment screws. The compression assemblies may each comprise at least one spring, which may be in the form of a cone-shaped spring member, and a structure that holds the spring in a predetermined position. Each of the compression assemblies may have a non-linear force/displacement curve associated therewith.

In another aspect, the invention is directed to a roll-forming station having a first rotatable arbor capable of supporting a first pair of forming rolls, a second rotatable arbor capable of supporting a second pair of forming rolls, a first support structure, a first bearing assembly associated with the first support structure that rotatably supports a first portion of the first arbor, a second bearing assembly associated with the first support structure that rotatably supports a first portion of the second arbor, a second support structure, a third bearing assembly associated with the second support structure that rotatably supports a second portion of the first arbor, and a fourth bearing assembly associated with the second support structure that rotatably supports a second portion of the second arbor. The first and second support structures support the bearing assemblies so that the first and second arbors are movable relative to each other exclusively in a vertical direction so that the first and second arbors are always aligned in a common vertical plane.

The roll-forming station also includes a first adjustment mechanism that allows the position of the first bearing assembly to be adjusted exclusively in a vertical direction relative to the position of the second bearing assembly, a second adjustment mechanism that allows the position of the third bearing assembly to be adjusted exclusively in a vertical direction relative to the position of the fourth bearing assembly, a first compression assembly that exerts a force upon the first bearing assembly when the first bearing assembly is moved away from the second bearing assembly in a vertical direction within the common vertical plane, and a second compression assembly that exerts a force upon the third bearing assembly when the third bearing assembly is moved away from the fourth bearing assembly in a vertical direction within the common vertical plane.

In a further aspect of the invention, the first and second adjustment mechanisms may be adjusted to support each of the first and third bearing assemblies in an initial position so that there is a predetermined initial gap between the forming rolls supported by the first arbor and the forming rolls supported by the second arbor when the first and third bearing assemblies are disposed in the initial positions. Each of the compression assemblies may be disposed in a pre-loaded condition so that each has a discontinuous force/displacement curve in order to cause each compression assembly to exert no force when its associated bearing assembly is disposed in its initial position and to cause the force exerted by each compression assembly to increase discontinuously to a non-zero force as soon as its associated bearing assembly is moved from its initial position to a displaced position.

The invention is also directed to a method of processing a sheet of material having a thickness with a roll-forming station, the roll forming station having a first rotatable arbor, a pair of forming rolls supported by the first rotatable arbor, a second rotatable arbor, a pair of forming rolls supported by the second rotatable arbor, first and second adjustment mechanisms that allow the position of the first arbor to be adjusted vertically relative to the position of the second arbor, and a compression assembly.

The method includes the steps of: (a) adjusting the first adjustment mechanism to an initial position so that the vertical gap between one of the forming rolls supported by the first arbor and one of the forming rolls supported by the second arbor is less than the thickness of the sheet of material, (b) adjusting the second adjustment mechanism to an initial position so that the vertical gap between one of the forming rolls supported by the first arbor and one of the forming rolls supported by the second arbor is less than the thickness of the sheet of material, and (c) passing the sheet of material between the forming rolls supported by the first and second arbors with the first and second adjustment mechanisms disposed in the initial positions so that the initial gap between the forming rolls disposed on the first arbor and the forming rolls on the second arbor is increased from the initial gap to a distance substantially equal to the thickness of the sheet of material, the increase in the initial gap causing a compression force to be applied to the sheet of material by the compression assembly.

The method may also include the step of using a compression assembly that provides a non-linear compression force and/or the step of adjusting the compression assembly to provide a non-zero compression pre-load prior to step (c).

The features and advantages of the invention will be apparent to those of ordinary skill in the art in view of the detailed description of the preferred embodiment, which is made with reference to the drawings, a brief description of which is provided below.

BRIEF DESCRIPTION OF THE DRAWINGS

FIGS. 4A–4E illustrate portions of a number of roll-forming stations used to form Z-shaped components;

FIGS. 5–8 illustrate a first type of adjustment mechanism for adjusting the vertical position of an annular forming roll;

FIG. 9 illustrates a second type of adjustment mechanism for adjusting the vertical position of an annular forming roll;

DETAILED DESCRIPTION OF THE PREFERRED EMBODIMENTS

Figure 1A:
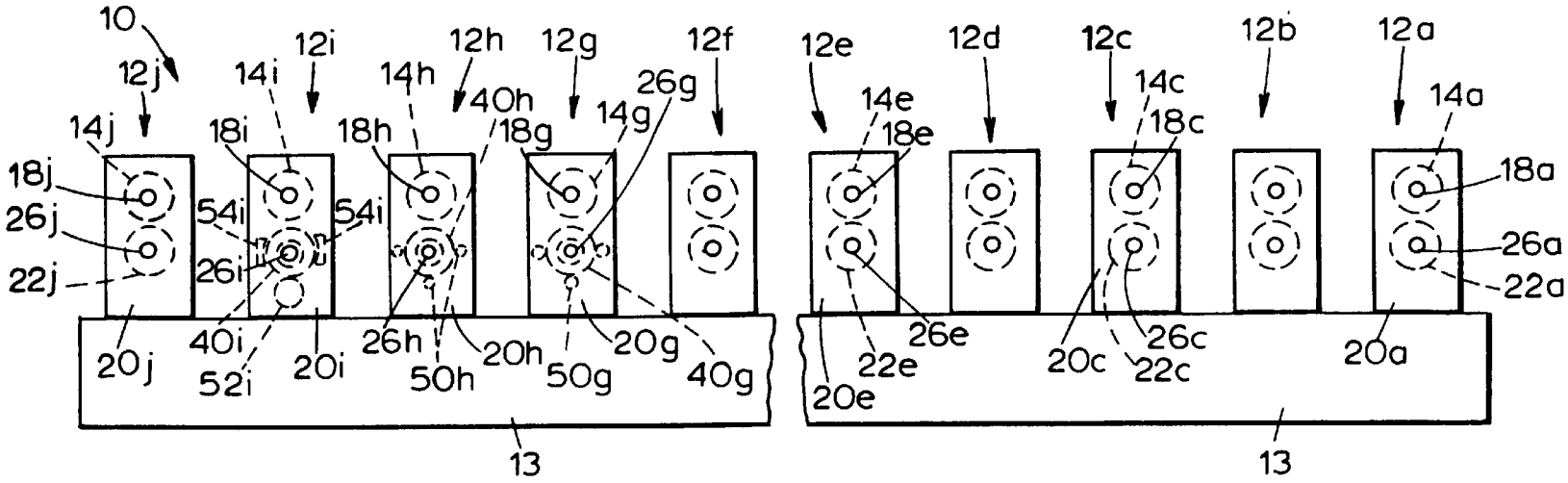
FIG. 1A is a schematic side view of a portion of a preferred embodiment of a roll-forming machine that forms components having C-shaped cross-sections.
Figure 1B:
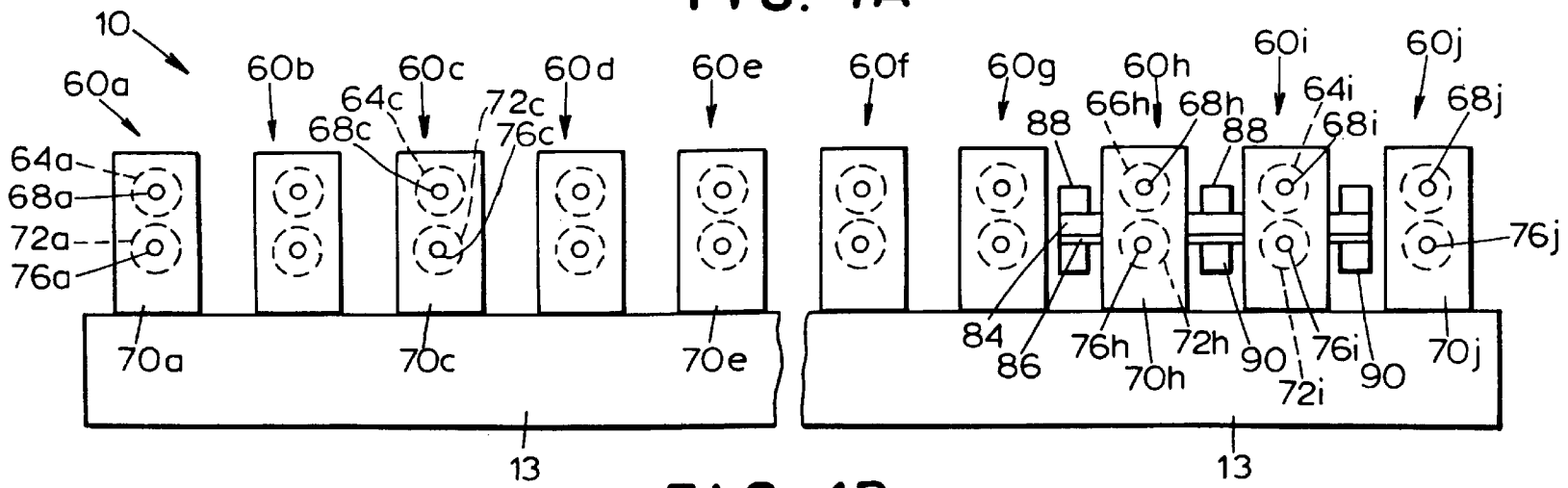
FIG. 1B is a schematic side view of a portion of a preferred embodiment of the roll-forming machine that forms components having Z-shaped cross-sections.

FIGS. 1A and 1B illustrate a schematic side view of a preferred embodiment of a roll-forming machine 10 in accordance with the invention. The roll-forming machine 10 is similar to that disclosed in allowed U.S. Ser. No. 09/154,853 filed Sept. 17, 1998, which is incorporated herein by reference in its entirety. Referring to FIG. 1A, the roll-forming machine 10 has a plurality of roll-forming stations 12*a*–12*j* supported by a base 13. The roll-forming stations 12*a*–12*j* are used to form a C-shaped component, such as a C-purlin, from a flat sheet of metal at room temperature.

Figures 3A, 3B, 3C:
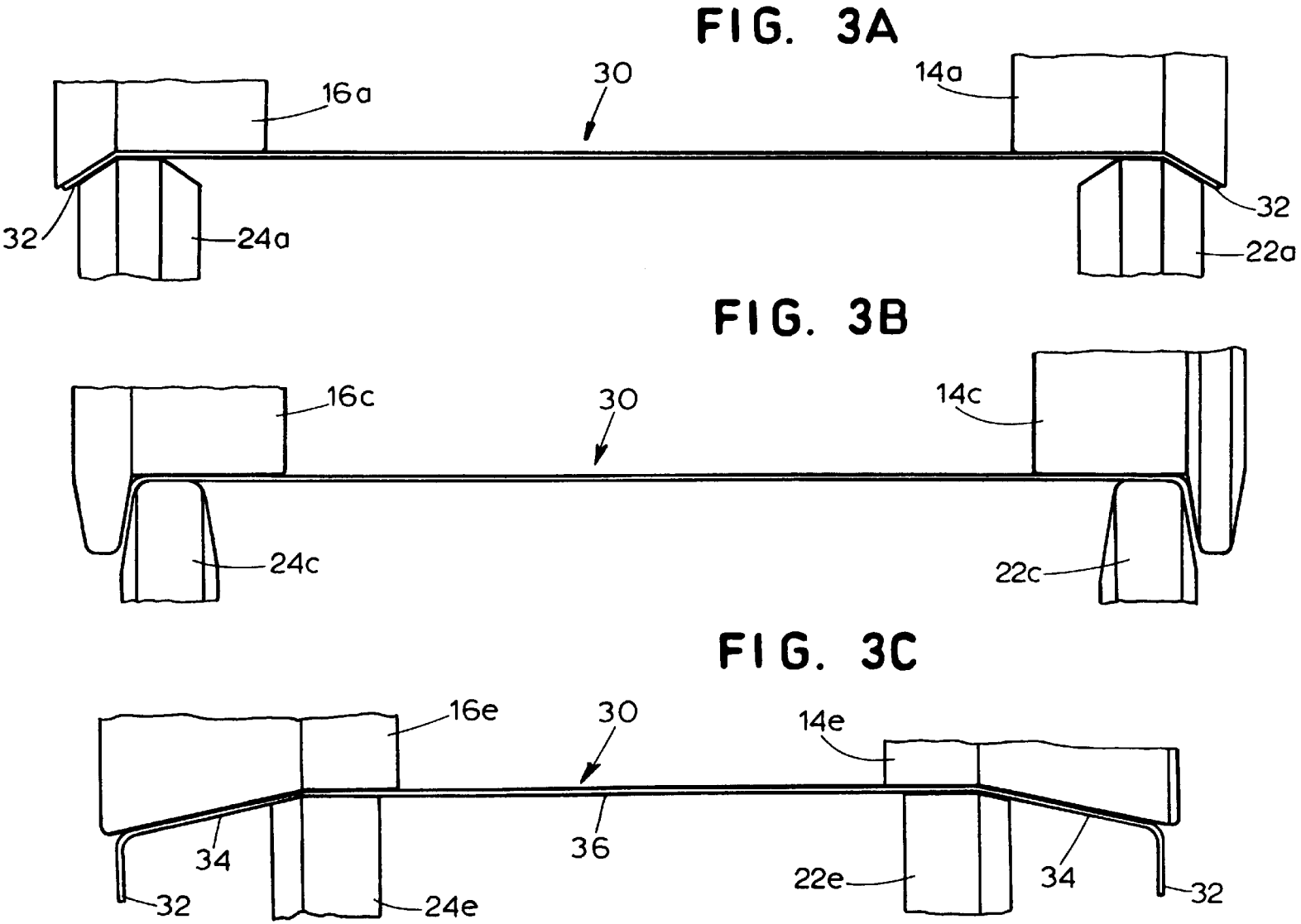
FIGS. 3A–3F illustrate portions of a number of roll-forming stations used to form C-shaped components.

The metal sheet enters the roll-forming station 12*a* first and passes between a pair of upper forming rolls 14*a*, 16*a* (see FIG. 3A) supported by a spindle or arbor 18*a* rotatably journalled in a pair of frame members 20*a* and a pair of lower forming rolls 22*a*, 24*a* (see FIG. 3A) supported by an arbor 26*a* rotatably journalled in the frame members 20*a*. The transverse shape of the forming rolls 14*a*, 16*a*, 22*a*, 24*a* is illustrated in FIG. 3A, which shows a pair of initial bends being formed in a metal sheet 30 to form a pair of flanges 32 at the transverse ends of the sheet 30.

After passing through the roll-forming station 12*b*, the sheet enters the roll-forming station 12*c*, where the two bends made to form the flanges 32 are increased. In the station 12*c*, the sheet passes between a pair of upper forming rolls 14*c*, 16*c* (see FIG. 3B) supported by an arbor 18*c* rotatably journalled in a pair of frame members 20*c* and a pair of lower forming rolls 22*c*, 24*c* (see FIG. 3B) supported by an arbor 26*c* rotatably journalled in the frame members 20*c*.

After passing through the roll-forming station 12*d*, the sheet enters the roll-forming station 12*e*, where two new bends are started to form a pair of legs 34 and a center portion 36 of the sheet or component 30. In the station 12*e*, the sheet passes between a pair of upper forming rolls 14*e*, 16*e* (see FIG. 3C) supported by an arbor 18*e* rotatably journalled in a pair of frame members 20*e* and a pair of lower forming rolls 22*e*, 24*e* (see FIG. 3C) supported by an arbor 26*e* rotatably journalled in the frame members 20*e*. Stations 12*f* (and any stations disposed between station 12*e* and 12*f*) are used to increase the bends that separate the leg portions 34 of the component 30 from its center portion 36.

At station 12*g*, the component 30 passes between a pair of upper forming rolls 14*g*, 16*g* (see FIG. 3D) supported by an arbor 18*g* rotatably journalled in a pair of frame members 20*g* and a pair of lower forming rolls 22*g*, 24*g* (see FIG. 3D) supported by an arbor 26*g* rotatably journalled in the frame members 20*g*. Station 12*g* also includes a third pair of annular forming rolls 40*g*, 42*g* that have a central hollow portion through which the lower arbor 26*g* passes. The annular forming rolls 40*g*, 42*g* have a pair of cylindrical surfaces 44*g*, 46*g*, each of which makes flush contact with a respective flange 32 of the component 30.

As described below, each of the annular forming rolls 40*g*, 42*g* is supported by a respective cradle mechanism, one of which is shown in FIG. 1A to include three support rollers 50*g*. The vertical position of the cradle mechanism, and thus of the annular forming rolls 40*g*, 42*g* is adjustable so that the cylindrical surfaces 44*g*, 46*g* may always make flush contact with the flanges 32 of the component 30 being formed, regardless of the length of the legs 34 of the component 30.

At station 12*h*, the component passes between a pair of upper forming rolls 14*h*, 16*h* (see FIG. 3E) supported by an arbor 18*h* rotatably journalled in a pair of frame members 20*h* and a pair of lower forming rolls 22*h*, 24*h* (see FIG. 3E) supported by an arbor 26*h* rotatably journalled in the frame members 20*h*. Station 12*h* includes a pair of annular forming rolls 40*h*, 42*h* having a central hollow portion through which the lower arbor 26*h* passes. The annular forming rolls 40*h*, 42*h* have a pair of cylindrical surfaces 44*h*, 46*h*, each of which makes flush contact with a respective flange 32 of the component 30. Each of the annular forming rolls 40*h*, 42*h* is supported by a respective cradle mechanism, one of which is shown in FIG. 1A to include three support rollers 50*h*.

At station 12*i*, the component passes between a pair of upper forming rolls 14*i*, 16*i* (see FIG. 3F) supported by an arbor 18*i* rotatably journalled in a pair of frame members 20*i* and a pair of lower forming rolls 22*i*, 24*i* (see FIG. 3F) supported by an arbor 26*i* rotatably journalled in the frame members 20*i*. Station 12*i* includes a pair of annular forming rolls 40*i*, 42*i* each having a central hollow portion through which the lower arbor 26*i* passes. The annular forming rolls 40*i*, 42*i* have a pair of cylindrical surfaces 44*i*, 46*i*, each of which makes flush contact with a respective flange 32 of the component 30. Each of the annular forming rolls 40*i*, 42*i* is supported by a respective cradle mechanism, one of which is shown in FIG. 1A to include a lower support roller 52*i* and a pair of side support members 54*i*.

The final station 12*j* may be used to apply an additional driving force to force the component 30 out of the roll-forming machine 10, and not to make any additional bends in the component 30.

FIG. 1B illustrates a second portion of the roll-forming machine 10 which forms a component 56 having a Z-shaped cross section from a flat sheet of metal. As shown in FIGS. 4C–4E, the component 56 has a center portion 57, a pair of leg portions 58 joined to the center portion 57, and a pair of flanges 59 joined to the leg portions 58.

Referring to FIG. 1B and FIGS. 4A through 4E, the Z-shaped component 56 is formed by successively feeding the metal sheet through a plurality of roll-forming stations 60*a* through 60*i*. The roll-forming stations 60 include a plurality of upper forming rolls 64*a*–64*i*, 66*a*–66*i* supported by a plurality of upper arbors 68*a*–68*i* rotatably journalled in a plurality of frame members 70*a*–70*i* and a plurality of lower forming rolls 72*a*–72*i*, 74*a*–74*i* supported by a plurality of lower arbors 76*a*–76*i* rotatably journalled in the frame members 70*a*–70*i*. The final station 60*j* may be used to apply an additional driving force to force the component 56 out of the roll-forming machine 10, and not to make any additional bends in the component 56.

As schematically shown in FIGS. 4D and 4E, the roll-forming stations 60*h* and 60*i* include a plurality of rollers 80*h*, 80*i*, 82*h*, 82*i* which make rolling contact with the Z-shaped component 56 at the intersections of the center and leg portions 57, 58 of the component 56. The purpose of the rollers 80*h*, 80*i*, 82*h*, 82*i* is to enable the formation of sharp bends at those intersections.

The rollers 80*h*, 80*i*, 82*h*, 82*i* are supported by a support structure shown schematically in FIG. 1B. Referring to FIG. 1B, that support structure includes a horizontal support bar 84 mounted to the two outer or "outboard" frame members 70*h*, 70*i*, a horizontal support bar 86 mounted to the two inner or "inboard" frame members 70*h*, 70*i*, three upper adjustment mechanisms 88 fixed to the support bar 84 for pivotally adjusting the position of the rollers 80*h*, 80*i*, and three lower adjustment mechanisms 90 fixed to the support bar 86 for pivotally adjusting the position of the rollers 82*h*, 82*i*.

Figure 2:
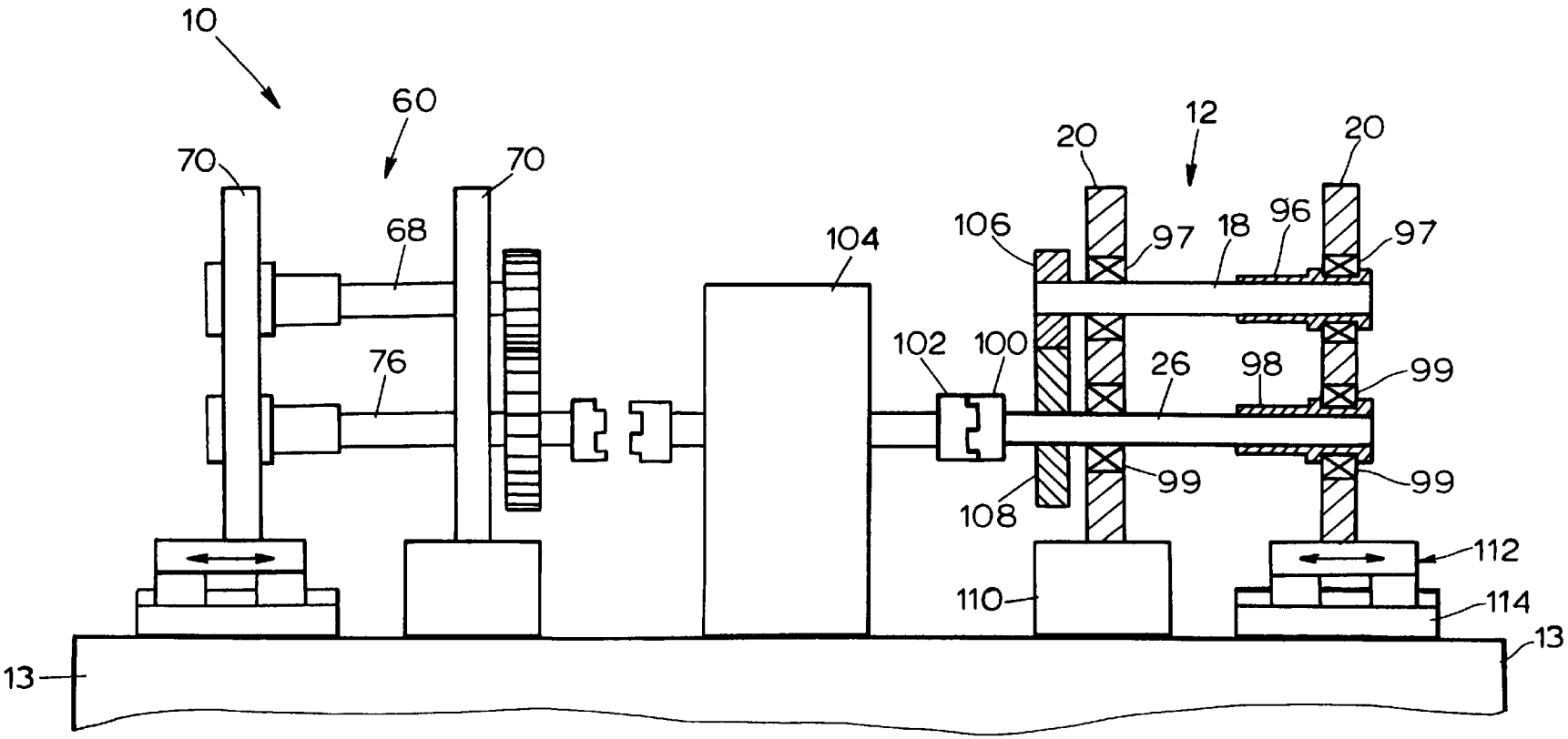
FIG. 2 is a schematic end view of the roll-forming machine of FIGS. 1A and 1lB.

FIG. 2 is a view of the roll-forming machine 10 (the forming rolls and other components not being shown) showing the general construction of two roll-forming stations 12, 60. The detailed structure of each of the roll-forming stations of the roll-forming machine 10 is described in a subsequent section of this patent.

Referring to the right-hand portion of FIG. 2, a sleeve 96 is disposed around the right-hand portion of the upper arbor 18, and a sleeve 98 is disposed around the right-hand portion of the lower arbor 26. Each of the sleeves 96, 98 has a keyed portion (not shown in FIG. 2) which extends into a respective slot (not shown in FIG. 2) formed in each of the arbors 18, 26 so that the upper arbor 18 and the sleeve 96 are forced to rotate together within bearings 97 (schematically shown) and so that the lower arbor 26 and the sleeve 98 are forced to rotate together within bearings 99 (schematically shown).

One of the upper forming rolls 16 (not shown in FIG. 2) is mounted to the left-hand side of the arbor 18 between the frame members 20, and the other upper forming roll 14 (not shown in FIG. 2) is mounted to the sleeve 96. Two lower forming rolls 22, 24 (not shown in FIG. 2) are similarly mounted to the lower arbor 26 and sleeve 98. The lower arbor 26 has a coupler 100 attached to its left end which mates with a horizontally movable coupler 102 that may be rotatably driven by a drive mechanism 104. The upper arbor 18 is rotatably driven via an upper gear 106 fixed to the upper arbor 18 and a lower gear 108 fixed to the lower arbor 26. As is well known, not all of the arbors of roll-forming stations need to be rotatably driven by the drive mechanism 104.

Referring to the right-hand side of FIG. 2, the inboard (left) frame member 20 is supported by a block 110 fixed to the machine base 13, and the outboard frame member 20 is supported by a base 112 slidably supported by a slide fixture 114 mounted on the machine base 13. By horizontally sliding the outboard frame member 20, the horizontal distance between the forming rolls mounted to the arbors 18, 26 and sleeves 96, 98 can be varied (to vary the transverse lengths of the center portion and leg portions of a component to be formed) since the sleeves 96, 98 slide horizontally along the arbors 18, 26 in response to movement of the outboard frame member 20.

The construction of the roll-forming stations 60 used to form Z-shaped components, shown in the left-hand side of FIG. 2, is substantially the same as the construction just described. The particular construction of the roll-forming stations 12, 60, which could take many forms in accordance with the invention, could be in accordance with U.S. Pat. No. 5,644,942 entitled "Roll Stand Raft Assembly," which is incorporated herein by reference.

FIGS. 5 through 8 illustrate the manner in which one of the annular forming rolls 42*g* is adjustably supported. Referring to FIG. 5, the annular forming roll 42*g* is supported by the three support rollers 50*g* shown schematically in Fig. 1A. Each of the support rollers 50*g* is mounted to an upper metal plate 120 by a respective bolt 122. The support rollers 50*g* include internal bearings (not shown) which allow them to freely rotate.

The plate 120 is pivotally connected to a mounting member 124 via a pivot member 126 connected to the plate 120 which passes through a cylindrical bore formed in the mounting member 124, the pivot member 126 being pivotally secured within the bore in the mounting member 124 via a collar 128. The mounting member 124 is fixed to the machine base 13 via a plurality of bolts 130.

The upper plate 120 has a U-shaped opening 132 formed therein to facilitate the passage of the arbor 26*g* and a sleeve 98*g* disposed around the arbor 26*g*. The upper plate 120 is connected to a lower plate 134, at an angle to the lower plate 134, via a pair of brackets 136 welded to both of the plates 120, 134. The lower plate 134 has a U-shaped opening 138 formed therein to accommodate the lowermost roller 50*g* (see FIG. 5).

A wheel support bracket 140 is connected to the bottom end of the lower plate 134 via a plurality of bolts 142. The bracket 140 has a roller 144 rotatably mounted to it via a nut and bolt assembly 146. As shown in FIG. 5, the roller 144 rests on a horizontal plate 150 that may be moved up and down within an enclosure formed by a number of walls 152.

Figure 3D:
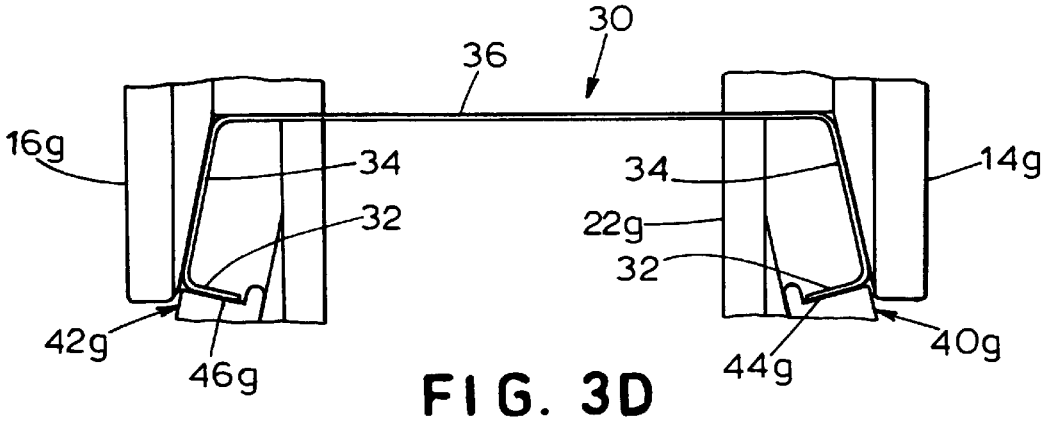

By moving the plate 150 up or down, the position of the annular forming roll 42*g* may be adjusted up or down so that its edge surface 46*g* may make flush contact with the flanges 32 of the component 30, as shown in FIG. 3D, regardless of the length of the legs 34 of the component 30. Referring to FIG. 5, when the plate 150 is forced upwards, the roller 144 and the plates 120, 134 to which it is connected are forced upwards in an arc, due to the upper plate 120 being pivotably connected to the stationary mounting fixture 124. Upward movement of the plate 120 causes upward movement of the rollers 50*g* which support or cradle the annular forming roll 42*g*, thus forcing the annular forming roll 42*g* upwards (for the case where the component 30 has relatively short legs 34). The upward and downward movement of the annular forming roll 42*g* is limited by the diameter of its central circular opening 154 through which the arbor 26*g* and sleeve 98*g* pass.

Figure 3E:
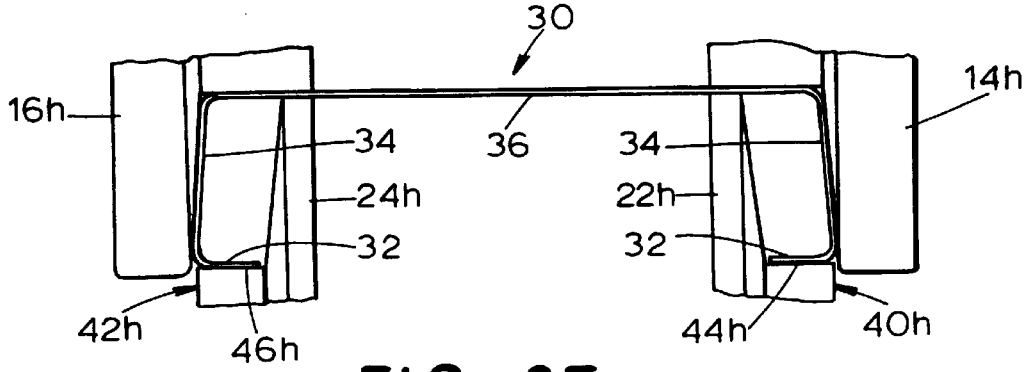
Figure 3F:
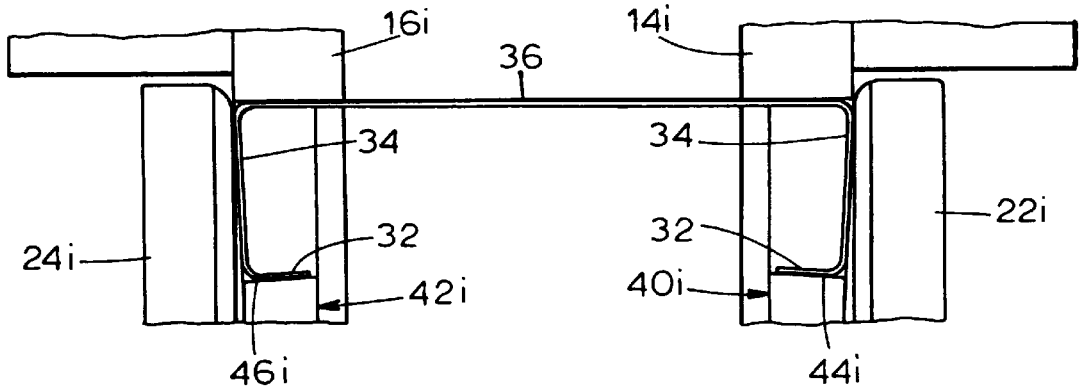

The structure for adjustably supporting the annular forming roll 40*g* shown in FIG. 3D is the same as that shown in FIGS. 5 through 8, except that components 124 and 136 are modified so that the forming roll 40*g* is supported at an angle symmetric to that of the forming roll 42*g*, as shown in FIG. 3D. The structure for adjustably supporting the annular forming rolls 40*h* and 42*h* shown in FIG. 3E is substantially the same as that shown in FIGS. 5 through 8, except that the component 124 is modified (by making its upper portion vertical instead of angled) and the components 136 eliminated (the lower plate 134 being welded directly to the upper plate 120) so that the forming rolls 40*h* and 42*h* are supported in a substantially vertical position, as shown in FIG. 3E.

FIG. 9 illustrates the structure for adjustably supporting the annular forming roll 40i of roll-forming station 12*i*. Referring to 9, that structure is similar to that shown in FIG. 5, except that the relatively large roller 52*i* shown schematically in FIG. 1 is used to support the bottom of the annular forming roll 40*i*, and the sides of the forming roll 42*i* are maintained in place by side support members 54*i*, which make sliding contact with the forming roll 40*i*. The bottom roller 52*i* is rotatably supported between a pair of plates 160 which are pivotally connected to a mounting fixture 162 as described above in connection with FIG. 5. Each of the side support members 54*i* is mounted to a respective mounting plate 164, each of which has a lower end connected between the plates 160. A positioning roller 166 may be used to aid in the positioning of the component 30 before it arrives at the roll-forming station 12*i*.

Figure 10:
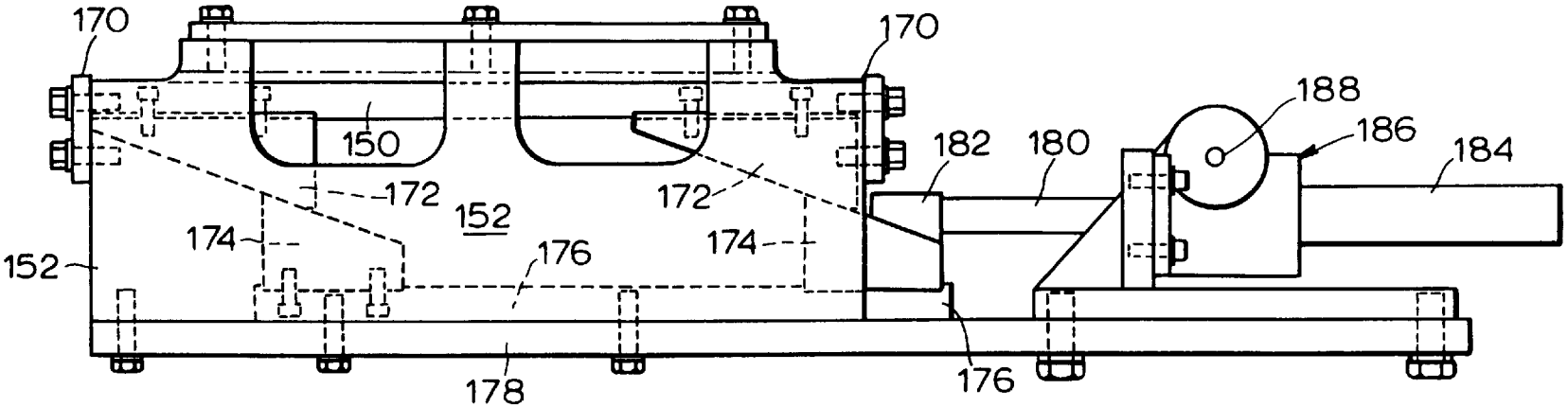
FIGS. 10–12 illustrate structure for adjusting the position of three vertically movable plates which supports the adjustment mechanisms shown in FIGS. 5–9.
Figure 12:
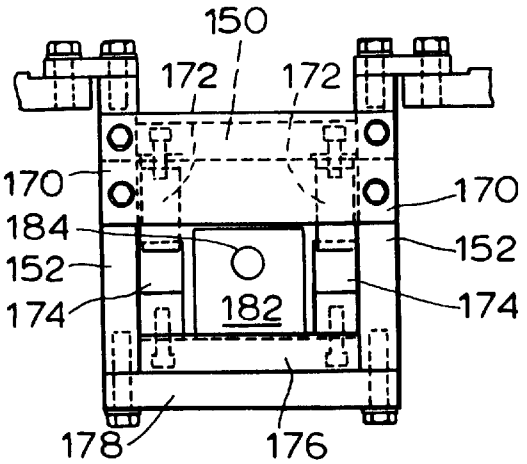
Figure 11:
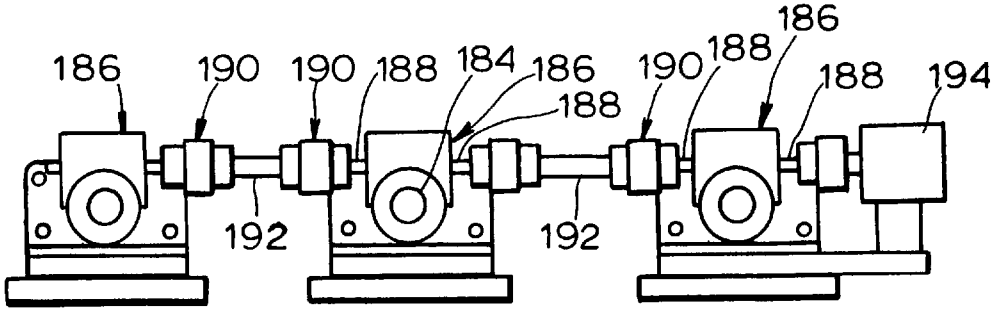

FIGS. 10–12 illustrate one manner of raising and lowering the plate 150 on which the rollers (e.g. roller 144 shown in FIG. 5) of the annular forming roll support mechanisms rest. Referring to FIG. 10, the plate 150 is snugly supported for vertical movement within an enclosure formed by the walls 152 and two additional walls 170. Four angled members 172 are bolted to the underside of the plate 150, and four similarly angled members 174 are bolted to the upper side of a horizontally shiftable plate 176, which rests on a base plate 178 to which the walls 152 are bolted.

A horizontally translatable rod 180 is connected to the shift plate 176 via a bracket 182 fixed to the upper side of the shift plate 176. For example, the end of the rod 180 may be threaded into a bore 184 (FIG. 12) formed in the bracket 182. The rod 180 may be horizontally translated into and out of a cylinder 184 under the control of a drive mechanism 186, such as a screw jack drive. The drive mechanism 186 may include a pair of coupling rods 188 disposed in a direction transverse to the rod 180, to facilitate interconnection of a plurality of the structures shown in FIG. 10, such as the assembly shown in FIG. 11.

FIG. 11 illustrates the interconnection of three drive mechanisms 186 via a plurality of couplers 190 and drive shafts 192, the right-most coupler 190 being connected to the drive shaft of a motor 194. With the construction shown in FIG. 11, the vertical position of the annular forming rolls 40*g*, 40*h*, 40*i* of the roll-forming stations 12*g*, 12*h*, 12*i* may be simultaneously adjusted via the motor 194.

In the operation of the roll-forming machine 10 described above, a sheet of material may be fed to a plurality of roll-forming stations to cause the flanges 32 and legs 34 of a C-shaped component 30 to be formed, the C-shaped component having a first leg length. After the formation of a number of such components, the roll-forming machine 10 can be reconfigured in a simplified manner to produce C-shaped components having different leg lengths.

This reconfiguration is accomplished by shifting the outboard frame members 20 in a horizontal direction, as described above in connection with FIG. 2, and then adjusting the vertical position of the three annular forming rolls 40*g*, 40*h*, 40*i*, as described above in connection with FIGS. 5 and 9–11. After such adjustments are made, C-shaped components having different leg lengths than the original C-shaped components can be formed.

Figure 13B:
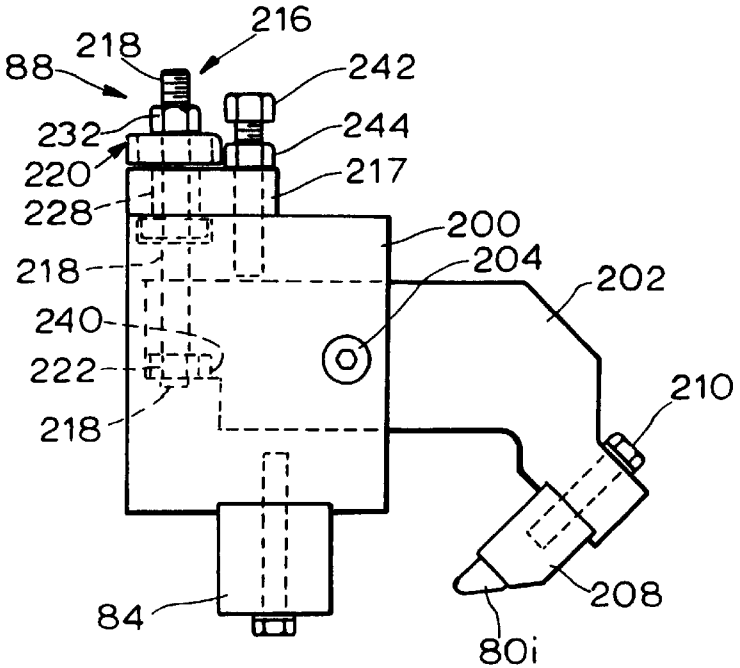
Figure 13A:
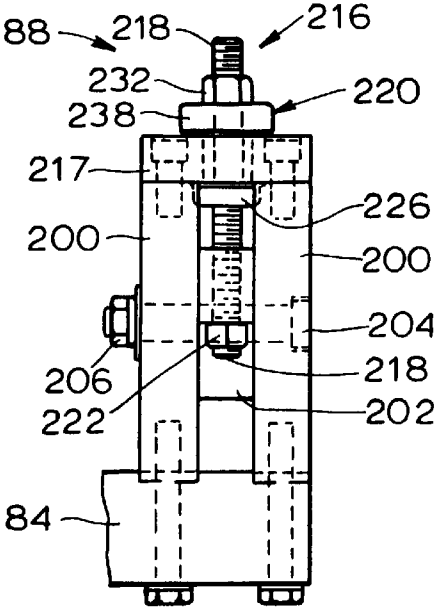
Figure 14:
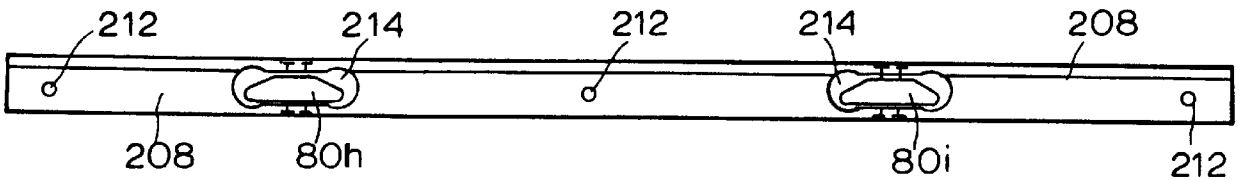

FIGS. 13A and 13B illustrate the structure of one of the upper adjustment mechanisms 88 shown schematically in FIG. 1B. Referring to FIGS. 13A and 13B, each adjustment mechanism 88 includes a pair of spaced-apart side plates 200 bolted to the top of the support bar 84 (shown schematically in FIG. 1B). A pivot arm 202 is pivotably disposed between the side plates 200 via a bolt 204 and a nut 206 threaded onto the bolt 204. The lower end of each pivot arm 202 is connected to a mounting bar 208 via a plurality of bolts 210 which are threaded into a plurality of holes 212 (see FIG. 14) formed in the mounting bar 208. As shown in FIG. 14, the rollers **80*h*, 80*i* (one of which is shown schematically in FIG. 4D and one of which is shown schematically in FIG. 4E) are rotatably supported by the mounting bar 208 within a respective elongate slot 214 formed in the mounting bar 208. The position of the rollers 80*h*, 80*i* relative to the forming rolls 66*h*, 72*h*, respectively, is adjustable so that different gap distances may be provided between those components 80*h*, 80*i*, 66*h*, 72*h* to accommodate the formation of Z-shaped components 56** having different thicknesses.

The angular position of the pivot arm 202, and thus of the rollers **80*h*, 80*i* is adjustable via an adjustment mechanism 216 connected to an upper plate 217 bolted to the top of the side plates 200. The adjustment mechanism 216 includes a headless screw 218, an adjustable collar assembly 220, and a nut 222 welded to the bottom end of the screw 218**.

Figure 15:
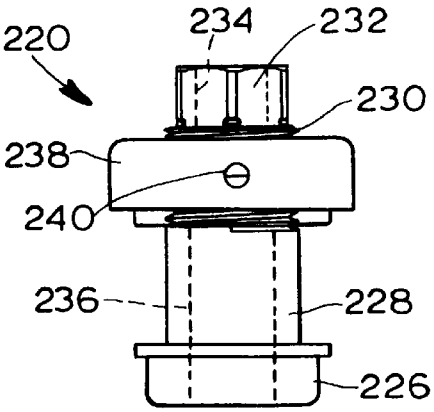
FIGS. 13A, 13B, 14 and 15 illustrate a first structure for pivotably supporting a plurality of contact rollers.

The structure of the adjustable collar assembly 220 is shown in FIG. 15. Referring to FIG. 15, the collar assembly 220 has a first component 224 having a cylindrical head 226, a cylindrical body portion 228, a threaded portion 230, and a nut portion 232, all of which are formed from a single piece of metal. The nut portion 232 has an internal threaded bore 234 formed therein, and the head and body portion 226, 228 have a smooth internal bore 236 formed therein coaxially with the threaded bore 234.

The collar assembly 220 has a second component in the form of an annular collar 238 that is threaded onto the threaded portion 230. One or more set screws 240 may be provided in the collar 238 to prevent the collar 238 from turning on the threaded portion 230 of the component 224.

Referring also to FIGS. 13A and 13B, the collar assembly 220 is installed on the top plate 217 by rotatably adjusting the position of the collar 238 until the space between the collar 238 and the head 226 is just sufficient to allow rotation of the collar assembly 220, and then the set screw(s) 240 in the collar 238 are tightened. Consequently, with the headless screw 218 passing through the threaded portion 234 of the nut 232, rotation of the nut 232 will cause the entire collar assembly 220 to rotate, which will cause vertical displacement of the screw 218 and the nut 222 welded to its bottom end. Neither the screw 218 or the nut 222 rotates since the nut 222 is provided within a narrow slot 240, formed in a lower surface of the pivot arm 202, which is just wide enough to accommodate the nut 222.

A bolt 242 is disposed through a threaded bore in the top plate 217 and has a lower end which abuts an upper surface of the pivot arm 202. A lock nut 244 is threaded onto the bolt 242 to lock its position. After the mechanism 216 has been adjusted to correspond to the desired position of the pivot arm 202 and the rollers **80*h*, 80*i*, the bolt 242 is rotated to move it in a downward direction until the lower end of the bolt 242 forces the left-hand end of the pivot arm 202 downwards so that it firmly abuts the nut 222 welded to the screw 218**.

Figure 16B:
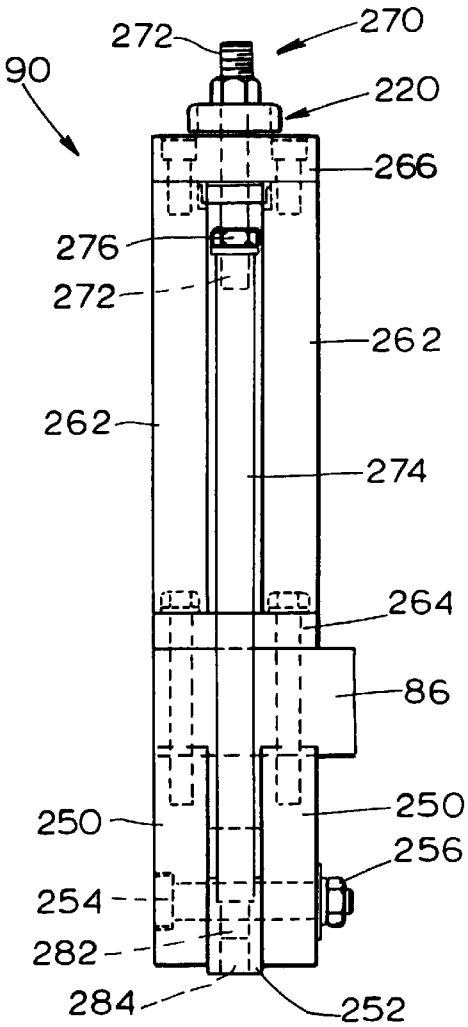
FIGS. 16A–16B illustrate a second structure for pivotably supporting a plurality of contact rollers.
Figure 16A:
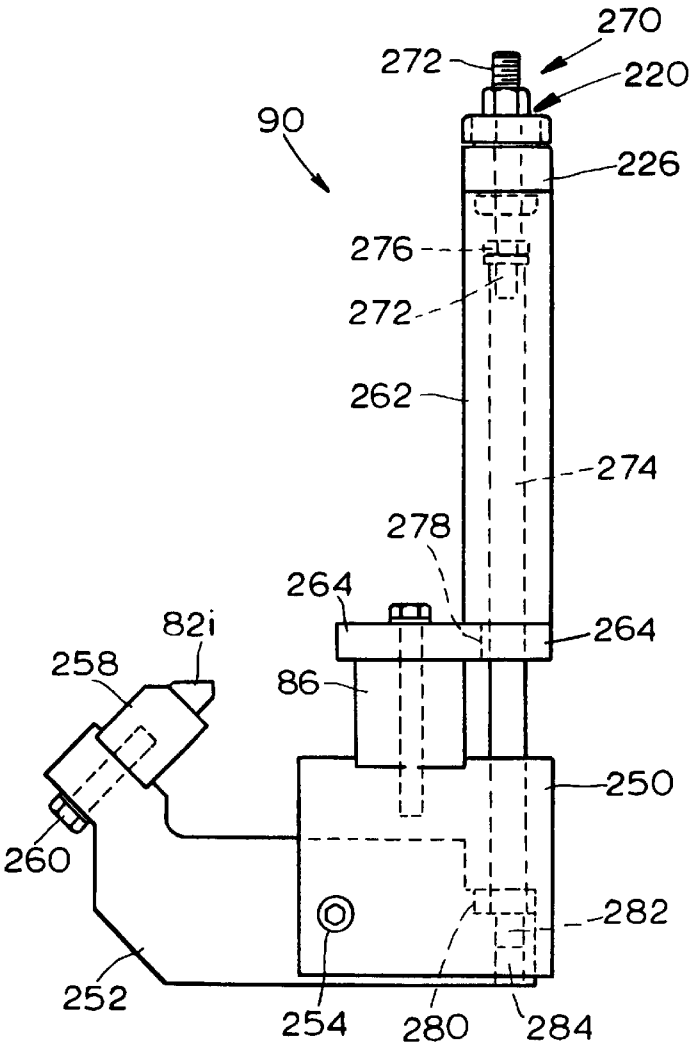

FIGS. 16A and 16B illustrate the construction of the lower adjustment mechanisms 90 (schematically shown in FIG. 1B) which are used to adjustably support the rollers **82*h*, 82*i* schematically shown FIGS. 4D and 4E. Referring to FIGS. 16A and 16B, each adjustment mechanism 90 has a pair of lower side plates 250 bolted to the bottom of the support bar 86 (shown schematically in Fig. 1B). A pivot arm 252 is pivotably disposed between the lower side plates 250 via a bolt 254 and a nut 256 threaded onto the bolt 254. The lower end of each pivot arm 252 is connected to a mounting bar 258 (which is substantially the same as the mounting bar 208 shown in FIG. 14), via a plurality of bolts 260**.

A pair of upper side plates 262 are connected to a horizontally disposed plate 264 bolted to the top of the support bar 86. A top plate 266 is bolted to the upper side plates 262. An adjustment mechanism 270 substantially the same as the adjustment mechanism 216 described above in connection with FIGS. 13A, 13B and 15 is connected to the top plate 266. The adjustment mechanism 270 includes the collar assembly 220 described above. A headless screw 272 is threaded through the collar assembly 220 into the top of an elongate rod 274 having a square cross section and is secured to the rod 274 by a locking nut 276. The elongate rod 274 passes through a rectangular slot 278 (FIG. 16A) formed in the plate 264 that prevents the rod 274 from rotating. The bottom portion of the rod 274 is disposed in a similar rectangular slot 280 (FIG. 16A) formed in an upper surface of the pivot member 252, and the bottom end of the rod 274 is provided with a cylindrical member 282 which is disposed within a cylindrical bore 284 in the pivot member 252.

The adjustment of the angular position of the pivot arms 252 and the rollers **82*h*, 82*i* is performed by rotating the collar assembly 220 in the same manner as described above in connection with FIGS. 13A and 13B. No locking assembly is necessary to lock the position of the pivot arms 252 since the weight of the left-hand ends of the pivot arms 252 and the support bar 258 forces the right-hand end of the pivot arms 252 upwards against the bottom end of the square portion of the elongate rod 274**.

It should be noted that, in addition to being pivotably adjustable, the position of the rollers 80 relative to the rollers 82 is also horizontally adjustable in a linear direction since the frame members 70 to which the adjustment mechanisms 88 are mounted are laterally movable, as described above in connection with FIG. 2.

Although the roll-forming machine 10 described above forms the flanges of the Z- and C-shaped components before forming the legs of those components, the machine 10 could be modified so that the legs of the Z- and/or C-shaped components are formed before the flanges.

Detailed Structure of Roll-Forming Stations

Figure 17:
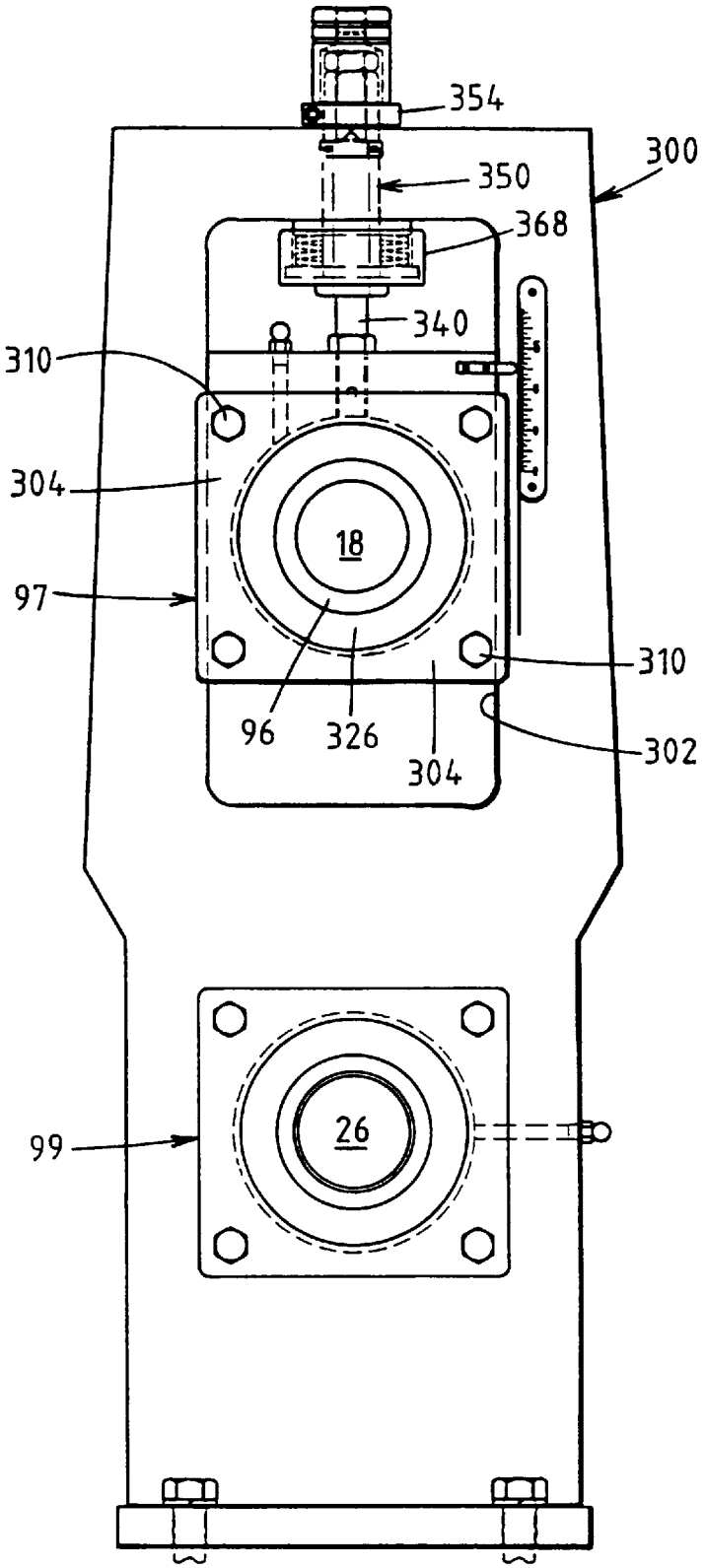
FIG. 17 is a side elevational view of one of the frame members 20 shown generally in FIG. 2.

The structure of each of the roll-forming stations of the roll-forming machine 10 is shown in more detail in FIGS. 17–19A. FIG. 17 is a side elevational view of one of the roll-forming stations shown generally in FIG. 2. Referring to FIG. 17, each roll-forming station may be provided with a pair of vertically disposed support plates 300, each of which acts as a support structure to support an end portion of each of the arbors 18, 26. Each support plate 300 may be provided with a rectangular slot 302 in which the upper bearing assembly 97 (shown schematically in FIG. 2) is disposed.

Figure 18:
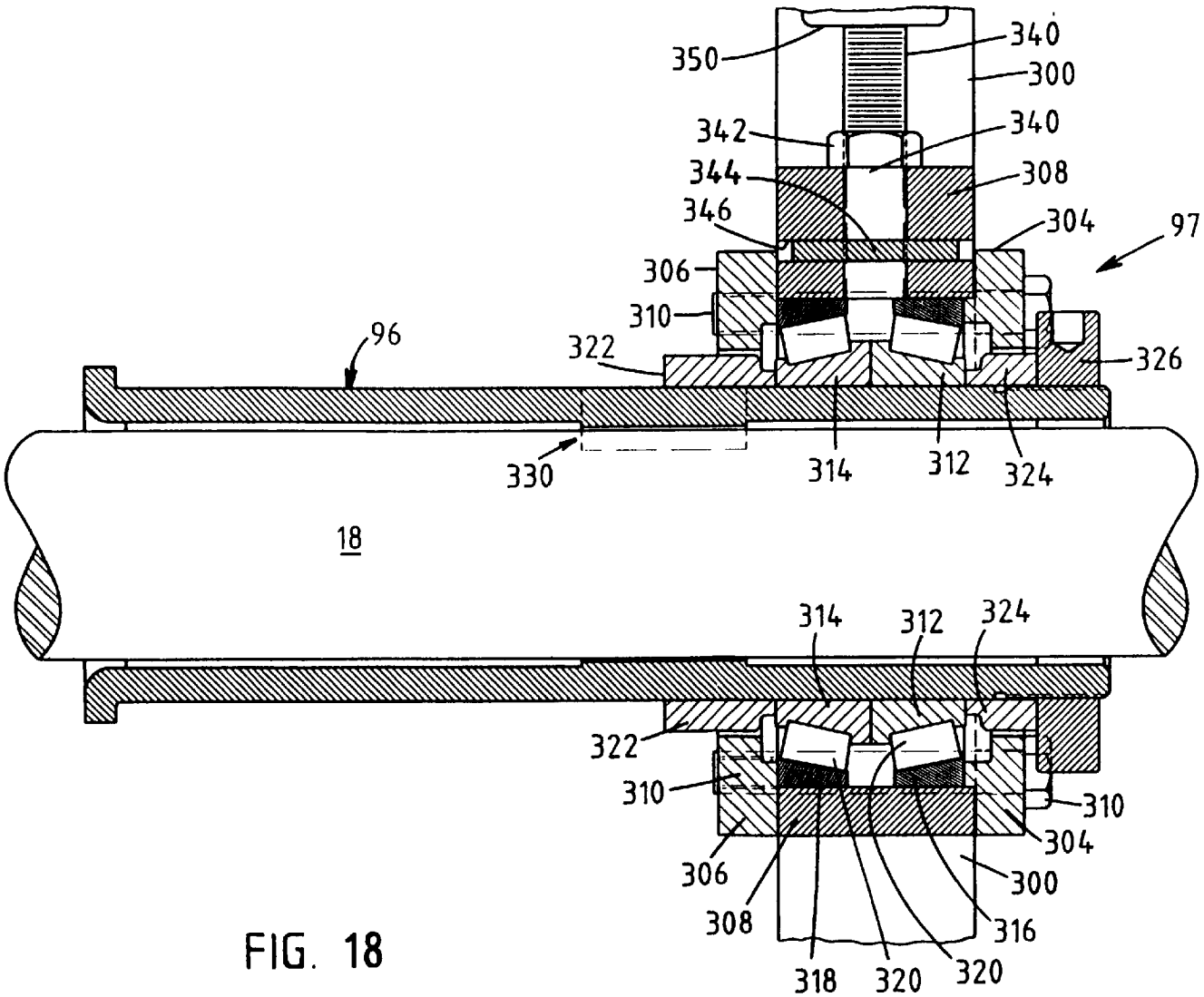
FIG. 18 is a cross-sectional view of one of the bearing assemblies used support an arbor.

Referring to FIGS. 17 and 18, the bearing assembly 97 may be provided with an outer bearing cap 304 and an inner bearing cap 306. Referring to FIG. 17, each of the bearing caps 304, 306 has a width that is greater than the width of the slot 302. The bearing caps 304, 306 are bolted on either side of a bearing block 308 via a plurality of bolts 310. As shown in the lower right portion of FIG. 18, the bearing block 308 may have the same thickness as the support plate 300, and the width of the bearing block 308 may be slightly smaller than the horizontal width of the slot 302 (see FIG. 17) so that the bearing block 308 may be moved smoothly within the slot 302 in a vertical direction.

Referring to FIG. 18, the bearing assembly 97 also includes an annular outer bearing cone 312 mounted on the sleeve 96, an annular inner bearing cone 314 mounted on the sleeve 96 adjacent the outer bearing cone 312, an annular outer bearing cup 316 mounted within an internal aperture formed in the bearing block 308, an annular inner bearing cup 318 mounted within the internal aperture formed in the bearing block 308, and a plurality of cylindrical roller bearings 320 rotatably disposed between the bearing cones 312, 314 and the bearing cups 316, 318.

An annular inner spacer 322 is mounted on the sleeve 96 adjacent the inner bearing cone 314, and an annular outer spacer 324 is mounted on the sleeve 96 adjacent the outer bearing cone 316. An annular locking collar 326 is threaded onto a threaded portion of the sleeve 96. The sleeve 96 also includes a key portion 330 which is disposed within a slot formed in the arbor 18 to ensure that the arbor 18 and the sleeve 96 always rotate together.

Referring to the upper portion of FIG. 18, an adjustment screw 340 is threaded into the upper portion of the bearing block 308. A jam nut 342 is disposed on the adjustment screw 340, and the adjustment screw 340 is locked in place within the bearing block 308 via a locking pin 344 which extends through a bore 346 drilled through the bearing block and through the center of the adjustment screw 340.

Figure 19B:
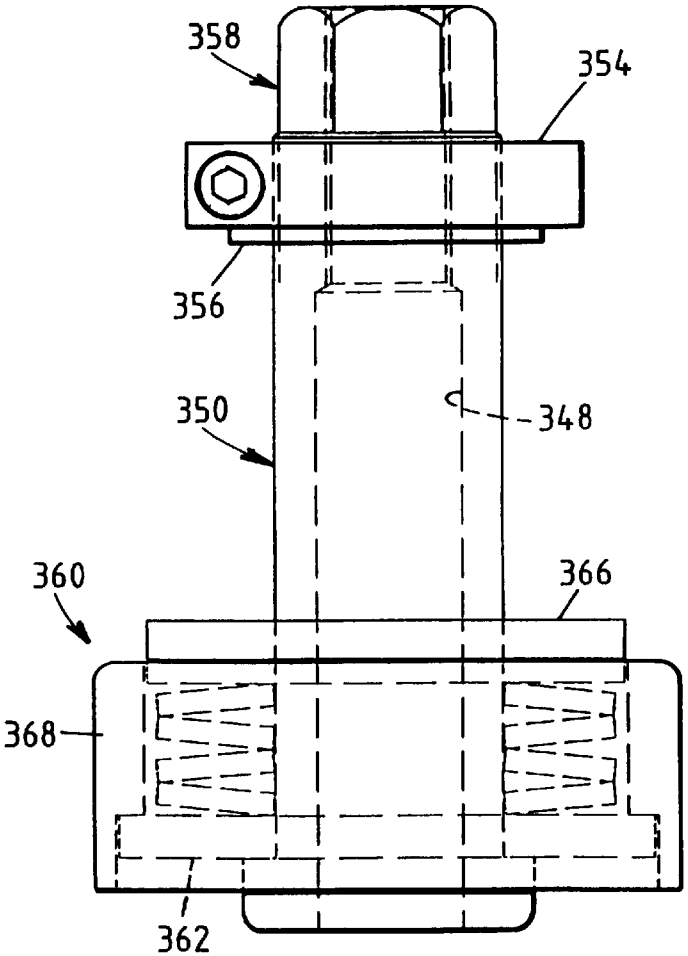
FIGS. 19A and l9B. illustrate an anchor mechanism and a compression mechanism.
Figure 19A:
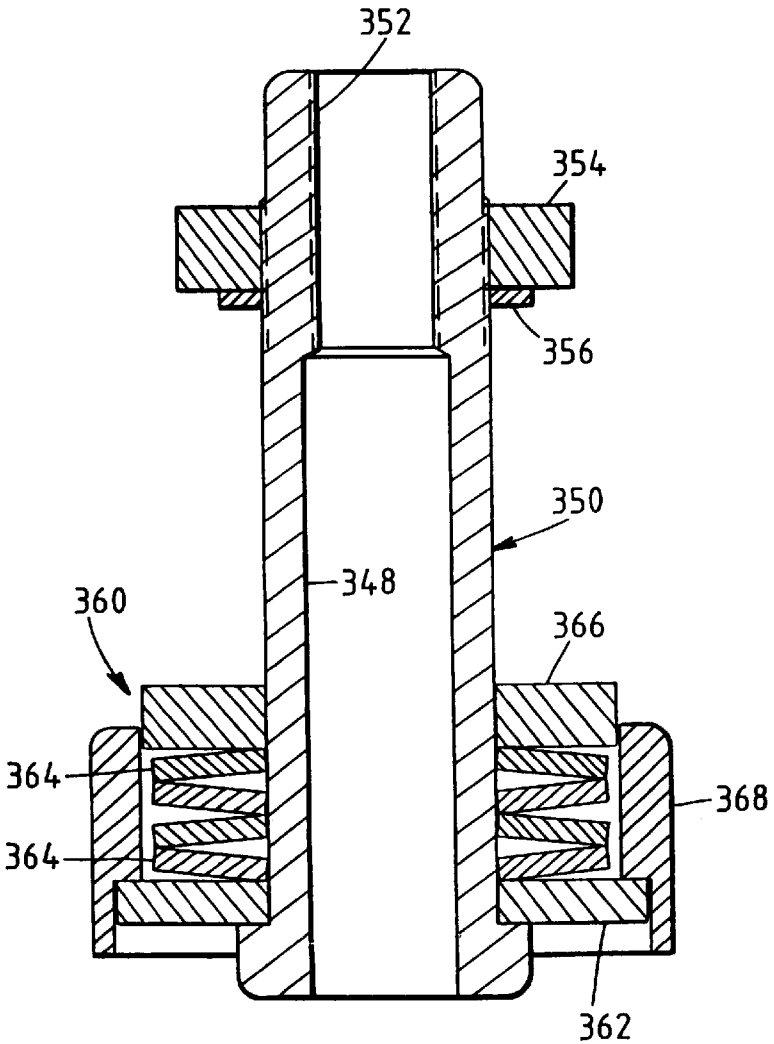

Referring to FIGS. 17, 19A and 19B, the adjustment screw 340 passes through an unthreaded lower bore 348 formed in a cylindrical anchor member 350, and the adjustment screw 340 is threaded into a threaded upper bore 352 formed in the anchor member 350. The anchor member 350 is disposed within a bore formed in the upper portion of the support plate 300, and a retaining collar 354 is threaded onto the upper portion of the anchor member 350 over a washer 356. The retaining collar 354, which has a diameter larger than the diameter of the bore formed in the upper portion of the support plate 300, retains the anchor member 350 and the adjustment screw 340 which is threaded into the bore 352, to the upper portion of the support plate 300.

Since the upper bearing assembly 97 is slidable within the slot 302 and supported by the adjustment screw 340, the vertical position of the upper bearing assembly 97 can be is adjusted by rotating the anchor 350 relative to the adjustment screw 340 to change the degree to which the adjustment screw is threaded into the anchor 350. The upper portion of the anchor 350 is hexagonally shaped at 358 (see FIG. 19B) to facilitate rotational adjustment of the anchor 350.

Referring to FIGS. 19A and 19B, a compression assembly 360 is supported by the anchor 350. The compression assembly 360 may include a lower washer 362 supported by an enlarged lower portion of the anchor, a plurality (e.g. four) of cone-shaped springs 364 (e.g. Bellville washers) disposed on top of the lower washer 362, an upper washer 366, and an annular cover 368.

The compression assembly 360 is installed on the roll-forming machine 10 by tightening the retaining collar 354 to at least such an extent that the upper washer 366 firmly abuts the upper surface of the slot 302 and so that the spring members 364 are in contact with the upper washer 366 and each other, and so that the lowermost spring member 364 is in contact with the lower washer 362.

When a sheet of material having a variable thickness is processed by the roll-forming machine 10, thicker portions of the sheet of material may cause the forming rolls supported by the upper arbor 18 to move upward, which in turn would cause the upper arbor 18, the bearing assembly 97, and the adjustment screw 340 to move upward as well. Such upward movement of the adjustment screw 340 would cause the anchor 350 to move upward relative to the support plate 300, which in turn would compress the springs 364 between the upper washer 366 (which is forced against the upper surface of the slot 302 and which does not move) and the lower washer 362 (which moves with the anchor 350). Consequently, a compression force would be applied to the sheet of material, the amount of which depended upon the force/deflection curve associated with the springs 364.

Figure 20A:
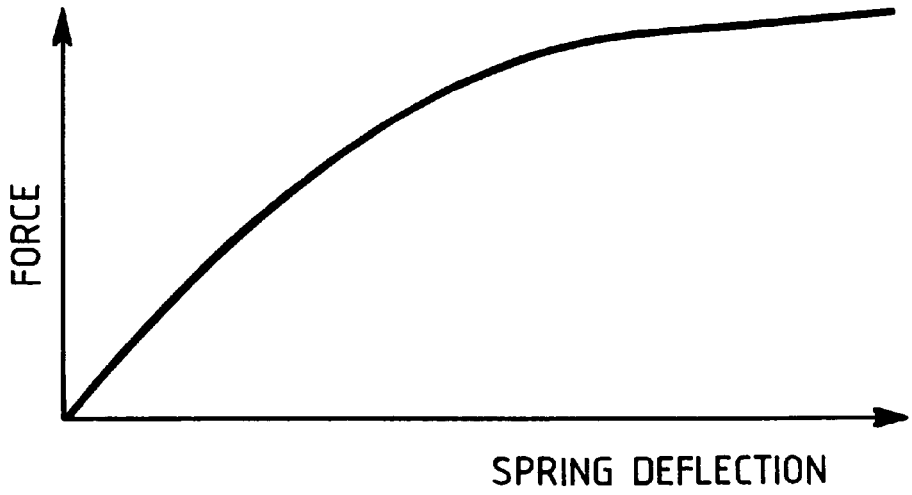
FIGS. 20A and 20B illustrate force/deflection curves provided by a compression mechanism.

One example of a non-linear force/deflection curve is illustrated in FIG. 20A. Referring to FIG. 20A, when the springs 364 are not deflected at all, there would be zero compression force applied to the sheet of material. As the springs became compressed or deflected, the compression force would increase at a non-linear rate, until the maximum compression force was reached at maximum compression or deflection of the springs 364.

As an alternative, the compression assembly 360 could be installed on the roll-forming machine 10 to provide a desired amount of compression pre-load. Such a pre-load would be provided by tightening the retaining collar 354 so that the enlarged bottom portion of the anchor 350 caused the springs 364 to become compressed between the lower washer 362 and the upper washer 366. In that case, the springs 364 would always apply a minimum compression force, and would always be compressed or deflected by a minimum amount, regardless of the vertical position of the upper arbor 18 and the bearing assembly 97.

Figure 20B:
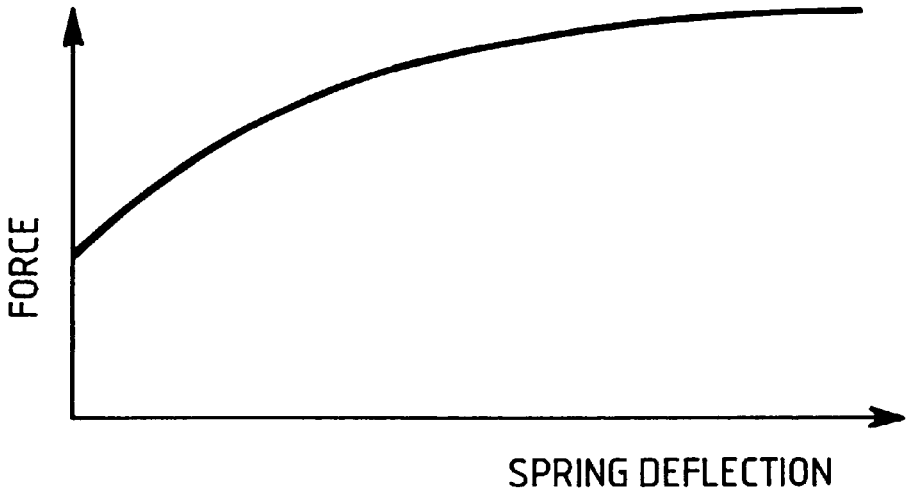

The compression force applied by the springs 364 in the case of such a compression pre-load is shown in FIG. 20B, which shows a discontinuous force/deflection curve. Referring to FIG. 20B, without any upward movement of the upper bearing assembly 97 caused by passage of a sheet of material through the roll-forming station, no compression force would be applied by the pre-loaded springs 364. However, as soon as the upper bearing assembly 97 is forced upwards by the sheet of material, thus forcing further deflection of the springs 364, the compression force immediately jumps to a non-zero value, corresponding to the amount by which the springs 364 are pre-loaded. As used herein, the term "discontinuous" means a force or curve that changes instantaneously (i.e. has a vertical slope) from one value to another.

Referring to FIGS. 17 and 19A, it should be noted that rotation of the anchor 350 (via the nut 358) will cause the adjustment screw 340 to move within the threaded portion 352 of the anchor 350, and will thus change the position of the bearing assembly 97 and the initial gap between the forming rolls disposed on the arbors 18, 26.

In order to change the pre-load generated by the springs 364, the retaining collar 354 is rotated, which will either pull the anchor 350 upwardly or will allow the anchor 350 to move downwardly. It should be noted that when the pre-load is changed by rotating the retaining collar 354, the initial gap between the forming rolls will also change since any change in vertical position of the anchor 350 will also result in a change in vertical position of the adjustment screw 340. Thus, for example, in order to change the initial gap between the forming rolls while retaining a predetermined pre-load (or zero pre-load), the anchor 350 can be rotated by a desired amount (to change the gap) and the retaining member 354 is rotated by the same amount (to maintain the same pre-load).

The roll-forming machine 10 described above can be used to process sheets of material having non-uniform thicknesses, such as a sheet of material having a relatively small thickness and a relatively large thickness. The roll-forming machine 10 can also be used to process sheets of material having uniform thickness. The roll-forming machine 10 can also be used to continuously process different sheets of material, where each sheet has a uniform but different thickness, without the need to change the initial vertical gap between the forming rolls.

In one method of using the roll-forming machine 10, the position of each of the adjustment screws 340 of each roll-forming station may be adjusted to an initial position so that the vertical gap (preferably a non-zero gap) between the forming rolls of the roll-forming stations is less than the thickness of a sheet of material, and then the sheet of material may be passed between the forming rolls supported by the arbors 18, 26 so that the initial gap between the forming rolls disposed on arbors 18, 26 is increased from the initial gap to a distance substantially equal to the thickness of the sheet of material to cause a compression force to be applied to the sheet of material by the compression assembly 360.

Although the compression assembly 360 of each roll-forming station has been described above as including a plurality of cone-shaped springs, alternative compression assemblies could be utilized. For example, springs of other shapes could be utilized. Alternatively, instead of using springs, other structures that would generate a desired compression force could be utilized, such as pneumatic cylinders or hydraulic systems provided with appropriate bleed valves.

The compression assemblies described above could also be used in connection with other forming rolls, or rollers, incorporated in the roll-forming machine 10. For example, the compression assemblies could be used in connection with the rollers 80, 82 which are designed to contact the corners of a sheet of material, as shown in FIGS. 4D and 4E for example. In that case, the compression assemblies could be incorporated in the structure which supports the rollers 80, 82, such as the structures shown in FIGS. 13A, 13B, 16A and 16B.

Numerous additional modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A roll-forming apparatus, comprising:

a base structure;

a plurality of first roll-forming stations associated with said base structure that form a first component having a Z-shaped cross section, said first component having a center portion and a pair of legs connected to said center portion; and a plurality of second roll-forming stations associated with said base structure that form a second component having a C-shaped cross section with a center portion and a pair of legs connected to said center portion, one of said roll-forming stations comprising:

a first rotatable arbor adapted to support a first pair of forming rolls;

a second rotatable arbor adapted to support a second pair of forming rolls;

a first support structure;

a first bearing assembly associated with said first support structure, said first bearing assembly rotatably supporting a first portion of said first arbor;

a second bearing assembly associated with said first support structure, said second bearing assembly rotatably supporting a first portion of said second arbor;

a second support structure;

a third bearing assembly associated with said second support structure, said third bearing assembly rotatably supporting a second portion of said first arbor;

a fourth bearing assembly associated with said second support structure, said fourth bearing assembly rotatably supporting a second portion of said second arbor;

a first adjustment mechanism associated with said first support structure and said first bearing assembly, said first adjustment mechanism allowing the position of said first bearing assembly to be adjusted relative to the position of said second bearing assembly;

a second adjustment mechanism associated with said second support structure and said third bearing assembly, said second adjustment mechanism allowing the position of said third bearing assembly to be adjusted relative to the position of said fourth bearing assembly;

a first compression assembly that exerts a force upon said first bearing assembly when said first bearing assembly is moved away from said second bearing assembly;

and a second compression assembly that exerts a force upon said third bearing assembly when said third bearing assembly is moved away from said fourth bearing assembly.

2. An apparatus as defined in claim 1 wherein each of said compression assemblies comprises a spring and a structure that holds said spring in a predetermined position.

3. An apparatus as defined in claim 1 wherein each of said compression assemblies comprises a pair of spring members.

4. An apparatus as defined in claim 1 wherein each of said compression assemblies comprises at least one cone-shaped spring member.

5. An apparatus as defined in claim 1 wherein said first and third bearing assemblies are movable and wherein said second and fourth bearing assemblies are disposed in fixed, non-movable positions.

6. A roll-forming station, comprising:

a first rotatable arbor capable of supporting a first pair of forming rolls;

a second rotatable arbor capable of supporting a second pair of forming rolls;

a first support structure;

a first bearing assembly associated with said first support structure, said first bearing assembly rotatably supporting a first portion of said first arbor;

a second bearing assembly associated with said first support structure, said second bearing assembly rotatably supporting a first portion of said second arbor;

a second support structure;

a third bearing assembly associated with said second support structure, said third bearing assembly rotatably supporting a second portion of said first arbor;

a fourth bearing assembly associated with said second support structure, said fourth bearing assembly rotatably supporting a second portion of said second arbor, said first and second support structures supporting said bearing assemblies so that said first and second arbors are movable relative to each other exclusively in a vertical direction so that said first and second arbors are always aligned in a common vertical plane;

a first adjustment mechanism associated with said first support structure and said first bearing assembly, said first adjustment mechanism allowing the position of said first bearing assembly to be adjusted exclusively in a vertical direction relative to the position of said second bearing assembly;

a second adjustment mechanism associated with said second support structure and said third bearing assembly, said second adjustment mechanism allowing the position of said third bearing assembly to be adjusted exclusively in a vertical direction relative to the position of said fourth bearing assembly;

a first compression assembly that exerts a force upon said first bearing assembly when said first bearing assembly is moved away from said second bearing assembly in a vertical direction within said common vertical plane; and a second compression assembly that exerts a force upon said third bearing assembly when said third bearing assembly is moved away from said fourth bearing assembly in a vertical direction within said common vertical plane, each of said compression assemblies having a non-linear force/displacement curve associated therewith.

7. A roll-forming station, comprising:

a first rotatable arbor;

a pair of forming rolls supported by said first rotatable arbor;

a second rotatable arbor;

a pair of forming rolls supported by said second rotatable arbor;

a first support structure;

a first bearing assembly associated with said first support structure, said first bearing assembly rotatably supporting a first portion of said first arbor;

a second bearing assembly associated with said first support structure, said second bearing assembly rotatably supporting a first portion of said second arbor;

a second support structure;

a third bearing assembly associated with said second support structure, said third bearing assembly rotatably supporting a second portion of said first arbor;

a fourth bearing assembly associated with said second support structure, said fourth bearing assembly rotatably supporting a second portion of said second arbor;

a first adjustment mechanism associated with said first support structure and said first bearing assembly, said first adjustment mechanism allowing the position of said first bearing assembly to be adjusted vertically relative to the position of said second bearing assembly;

a second adjustment mechanism associated with said second support structure and said third bearing assembly, said second adjustment mechanism allowing the position of said third bearing assembly to be adjusted vertically relative to the position of said fourth bearing assembly, said first and second adjustment mechanisms being adjusted to support each of said first and third bearing assemblies in an initial position so that there is a predetermined initial gap between said forming rolls supported by said first arbor and said forming rolls supported by said second arbor when said first and third bearing assemblies are disposed in said initial positions;

a first compression assembly associated with said first adjustment mechanism, said first compression assembly being disposed in a pre-loaded condition so that it has a discontinuous force/displacement curve, said discontinuous force/displacement curve causing said first compression assembly to exert no force when said first bearing assembly is disposed in its initial position and causing the force exerted by said first compression assembly to increase discontinuously to a non-zero force as soon as said first bearing assembly is moved from its initial position in a direction away from said second bearing assembly to a displaced position; and a second compression assembly associated with said second adjustment mechanism, said second compression assembly being disposed in a pre-loaded condition so that it has a discontinuous force/displacement curve, said discontinuous force/displacement curve of said second compression assembly causing said second compression assembly to exert no force when said third bearing assembly is disposed in its initial position and causing the force exerted by said second compression assembly to increase discontinuously to a non-zero force as soon as said third bearing assembly is moved from its initial position in a direction away from said fourth bearing assembly to a displaced position.

8. An apparatus as defined in claim 7 wherein said first support structure comprises a vertically disposed support plate and a slot formed in said support plate and wherein said first bearing assembly is movable along a vertical direction within said slot.

9. An apparatus as defined in claim 7 wherein each of said adjustment mechanisms comprises an adjustment screw.

10. An apparatus as defined in claim 7 wherein each of said compression assemblies comprises a spring and a structure that holds said spring in a predetermined position.

11. An apparatus as defined in claim 7 wherein each of said compression assemblies comprises at least one cone-shaped spring member.

12. An apparatus as defined in claim 7 wherein said first and third bearing assemblies are movable and wherein said second and fourth bearing assemblies are disposed in fixed, non-movable positions.

13. An apparatus as defined in claim 7 wherein each of said compression assemblies has a non-linear force/displacement curve associated therewith.

14. A roll-forming station, comprising:

a first rotatable arbor;

a pair of forming rolls supported by said first rotatable arbor;

a second rotatable arbor;

a pair of forming rolls supported by said second rotatable arbor;

a first support structure;

a first bearing assembly associated with said first support structure, said first bearing assembly rotatably supporting a first portion of said first arbor;

a second bearing assembly associated with said first support structure, said second bearing assembly rotatably supporting a first portion of said second arbor;

a second support structure;

a third bearing assembly associated with said second support structure, said third bearing assembly rotatably supporting a second portion of said first arbor;

a fourth bearing assembly associated with said second support structure, said fourth bearing assembly rotatably supporting a second portion of said second arbor;

a first adjustment mechanism associated with said first support structure and said first bearing assembly, said first adjustment mechanism allowing the position of said first bearing assembly to be adjusted vertically relative to the position of said second bearing assembly;

a second adjustment mechanism associated with said second support structure and said third bearing assembly, said second adjustment mechanism allowing the position of said third bearing assembly to be adjusted vertically relative to the position of said fourth bearing assembly;

a first compression assembly associated with said first adjustment mechanism, said first compression assembly having a non-linear force/displacement curve so that said first bearing mechanism is subjected to a force that is non-linear with respect to displacement of said first bearing mechanism relative to said second bearing mechanism; and a second compression assembly associated with said second adjustment mechanism, said second compression assembly having a non-linear force/displacement curve so that said third bearing mechanism is subjected to a force that is non-linear with respect to displacement of said third bearing mechanism relative to said fourth bearing mechanism.

15. An apparatus as defined in claim 14 wherein said first support structure comprises a vertically disposed support plate and a slot formed in said support plate and wherein said first bearing assembly is movable along a vertical direction within said slot.

16. An apparatus as defined in claim 14 wherein each of said adjustment mechanisms comprises an adjustment screw.

17. An apparatus as defined in claim 14 wherein each of said compression assemblies comprises a spring and a structure that holds said spring in a predetermined position.

18. An apparatus as defined in claim 14 wherein each of said compression assemblies comprises at least one cone-shaped spring member.

19. An apparatus as defined in claim 14 wherein said first and third bearing assemblies are movable and wherein said second and fourth bearing assemblies are disposed in fixed, non-movable positions.

20. A method of processing a sheet of material having a thickness with a roll-forming station, said roll forming station having a first rotatable arbor, a pair of forming rolls supported by said first rotatable arbor, a second rotatable arbor, a pair of forming rolls supported by said second rotatable arbor, first and second adjustment mechanisms that allow the position of said first arbor to be adjusted vertically relative to the position of said second arbor, and a compression assembly, said method comprising the steps of:

(a) adjusting said first adjustment mechanism to an initial position so that the vertical gap between one of said forming rolls supported by said first arbor and one of said forming rolls supported by said second arbor is less than said thickness of said sheet of material;

(b) adjusting said second adjustment mechanism to an initial position so that the vertical gap between one of said forming rolls supported by said first arbor and one of said forming rolls supported by said second arbor is less than said thickness of said sheet of material;

(c) passing said sheet of material between said forming rolls supported by said first and second arbors with said first and second adjustment mechanisms disposed in said initial positions so that the initial gap between said forming rolls disposed on said first arbor and said forming rolls on said second arbor is increased from said initial gap to a distance substantially equal to said thickness of said sheet of material, said increase in said initial gap causing a compression force to be applied to said sheet of material by said compression assembly; and (d) using a compression assembly that provides a non-linear compression force.

21. A method of processing a sheet of material having a thickness with a roll-forming station, said roll forming station having a first rotatable arbor, a pair of forming rolls supported by said first rotatable arbor, a second rotatable arbor, a pair of forming rolls supported by said second rotatable arbor, first and second adjustment mechanisms that allow the position of said first arbor to be adjusted vertically relative to the position of said second arbor, and a compression assembly, said method comprising the steps of:

(a) adjusting said first adjustment mechanism to an initial position so that the vertical gap between one of said forming rolls supported by said first arbor and one of said forming rolls supported by said second arbor is less than said thickness of said sheet of material;

(b) adjusting said second adjustment mechanism to an initial position so that the vertical gap between one of said forming rolls supported by said first arbor and one of said forming rolls supported by said second arbor is less than said thickness of said sheet of material; and (c) passing said sheet of material between said forming rolls supported by said first and second arbors with said first and second adjustment mechanisms disposed in said initial positions so that the initial gap between said forming rolls disposed on said first arbor and said forming rolls on said second arbor is increased from said initial gap to a distance substantially equal to said thickness of said sheet of material, said increase in said initial gap causing a compression force to be applied to said sheet of material by said compression assembly, wherein said step (c) comprises the step of passing a sheet of material having a first relatively large thickness and a second relatively small thickness between said forming rolls, wherein said step (a) comprises the step of adjusting said first adjustment mechanism so that said vertical gap recited in said step (a) is less than said first relatively large thickness but not less than said second relatively small thickness, and wherein said step (b) comprises the step of adjusting said second adjustment mechanism so that said vertical gap recited in said step (b) is less than said first relatively large thickness but not less than said second relatively small thickness.

* * * * *